US012286784B1

(12) United States Patent
Rennard

(10) Patent No.: US 12,286,784 B1
(45) Date of Patent: Apr. 29, 2025

(54) BEAM SUPPORT STRUCTURE

(71) Applicant: Carl J. Rennard, Lincoln, RI (US)

(72) Inventor: Carl J. Rennard, Lincoln, RI (US)

( * ) Notice: Subject to any disclaimer, the term of this patent is extended or adjusted under 35 U.S.C. 154(b) by 0 days.

(21) Appl. No.: 18/640,471

(22) Filed: Apr. 19, 2024

Related U.S. Application Data

(63) Continuation-in-part of application No. 18/601,298, filed on Mar. 11, 2024, which is a continuation-in-part of application No. 18/403,065, filed on Jan. 3, 2024.

(51) Int. Cl.
*E04B 1/19* (2006.01)

(52) U.S. Cl.
CPC ..... *E04B 1/19* (2013.01); *E04B 2001/1924* (2013.01)

(58) Field of Classification Search
CPC ..... E04B 1/19; E04B 2001/1924
See application file for complete search history.

(56) References Cited

U.S. PATENT DOCUMENTS 3,164,353 A * 1/1965 Ralph ..... E04G 3/265 248/237
3,837,609 A 9/1974 Weiss et al.
4,381,635 A * 5/1983 Solo ..... E04C 3/17 52/639
5,163,568 A 11/1992 Laurendeau et al.
5,603,187 A * 2/1997 Merrin ..... F24S 25/61 52/90.2
5,681,021 A * 10/1997 Noll ..... E04G 23/0266 248/237
6,488,257 B2 12/2002 McSwain
6,546,686 B2 * 4/2003 MacKarvich ..... E02D 27/02 248/680
6,668,510 B2 12/2003 McManus
6,993,883 B2 2/2006 Belanger
7,509,702 B2 3/2009 Cantis et al.
(Continued)

FOREIGN PATENT DOCUMENTS

WO WO-2011057377 A1 * 5/2011 ..... E04C 3/18
WO WO-2017220987 A1 * 12/2017 ..... A47B 47/027

OTHER PUBLICATIONS

Online article titled "building a deck; best practices" from buildingadvisor.com, dated by archive.org at Aug. 1, 2017 https://buildingadvisor.com/materials/decks-porches/deck-construction/ (Year: 2017).*
(Continued)

*Primary Examiner* — Eret C McNichols
*Assistant Examiner* — Ding Y Tan
(74) *Attorney, Agent, or Firm* — Salter & Michaelson

(57) ABSTRACT

A beam support structure that is formed of a first bracket for supporting a first beam or post; and a second bracket for supporting a second beam. Each of the first and second brackets are of U-shape including a base wall and a pair of side walls that extend orthogonal to the base wall, and a support flange that extends parallel to the pair of side walls and an arm having respective ends that connect between the respective flanges of the first and second brackets. The arm is secured between the first and second brackets, while allowing multiple different secured positions between the first and second brackets. A leveling member may be associated with each bracket and arm.

20 Claims, 24 Drawing Sheets

(56) References Cited

U.S. PATENT DOCUMENTS

| | | | | |
|---|---|---|---|---|
| 7,658,356 | B1 | 2/2010 | Nehls | |
| 8,636,456 | B2 | 1/2014 | Dayton et al. | |
| 8,919,060 | B1 * | 12/2014 | Oliver | E02D 27/48 405/230 |
| 9,321,169 | B1 | 4/2016 | Satur | |
| 10,995,496 | B2 | 5/2021 | Burt et al. | |
| 11,149,431 | B1 * | 10/2021 | Meznarich | E04B 7/022 |
| 2008/0277551 | A1 * | 11/2008 | Hackney | E04B 1/2604 248/276.1 |
| 2009/0151294 | A1 * | 6/2009 | Staley | E04G 21/1891 52/655.1 |
| 2012/0042527 | A1 * | 2/2012 | Olsen | G01C 15/12 33/286 |
| 2014/0318073 | A1 * | 10/2014 | Sidhu | E04B 5/12 52/702 |
| 2019/0285224 | A1 * | 9/2019 | McKechnie | F16M 11/18 |
| 2021/0310237 | A1 * | 10/2021 | Marlow | E04B 1/2604 |
| 2024/0287805 | A1 * | 8/2024 | Lethin | E04D 3/3608 |

OTHER PUBLICATIONS

Inspectapedia online article titled "deck post installation procedure" https://inspectapedia.com/decks/Deck_Post_Install.php dated by archive.org at Jun. 11, 2017 (Year: 2017).*

AiMaKoDo adjustable angle roof riser pergola brackets sold on amazon.com https://www.amazon.com/AiMaKoDo-Adjustable-Pergola-Brackets-Stainless/dp/B0CNT68BGN?th=1 first available date: Nov. 22, 2023 (Year: 2023).*

Johnson magnetic pocket level model # 1721P online product page, https://www.johnsonlevel.com/P/2059/MagneticPocketLevel dated by archive.org at Aug. 14, 2022 (Year: 2022).*

HDG Inc engineering products structural deck support system 2021 catalog (Year: 2021).*

Lo-Pro Patio Roof Riser for pergola roof hardware sold on amazon dated Jun. 1, 2022 https://www.amazon.com/Patio-Roof-Riser-LO-PRO-Mount/dp/B0B2X7389D (Year: 2022).*

* cited by examiner

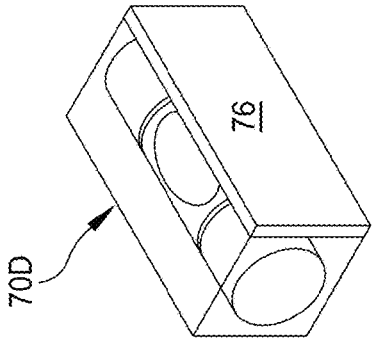
FIG. 36
FIG. 35
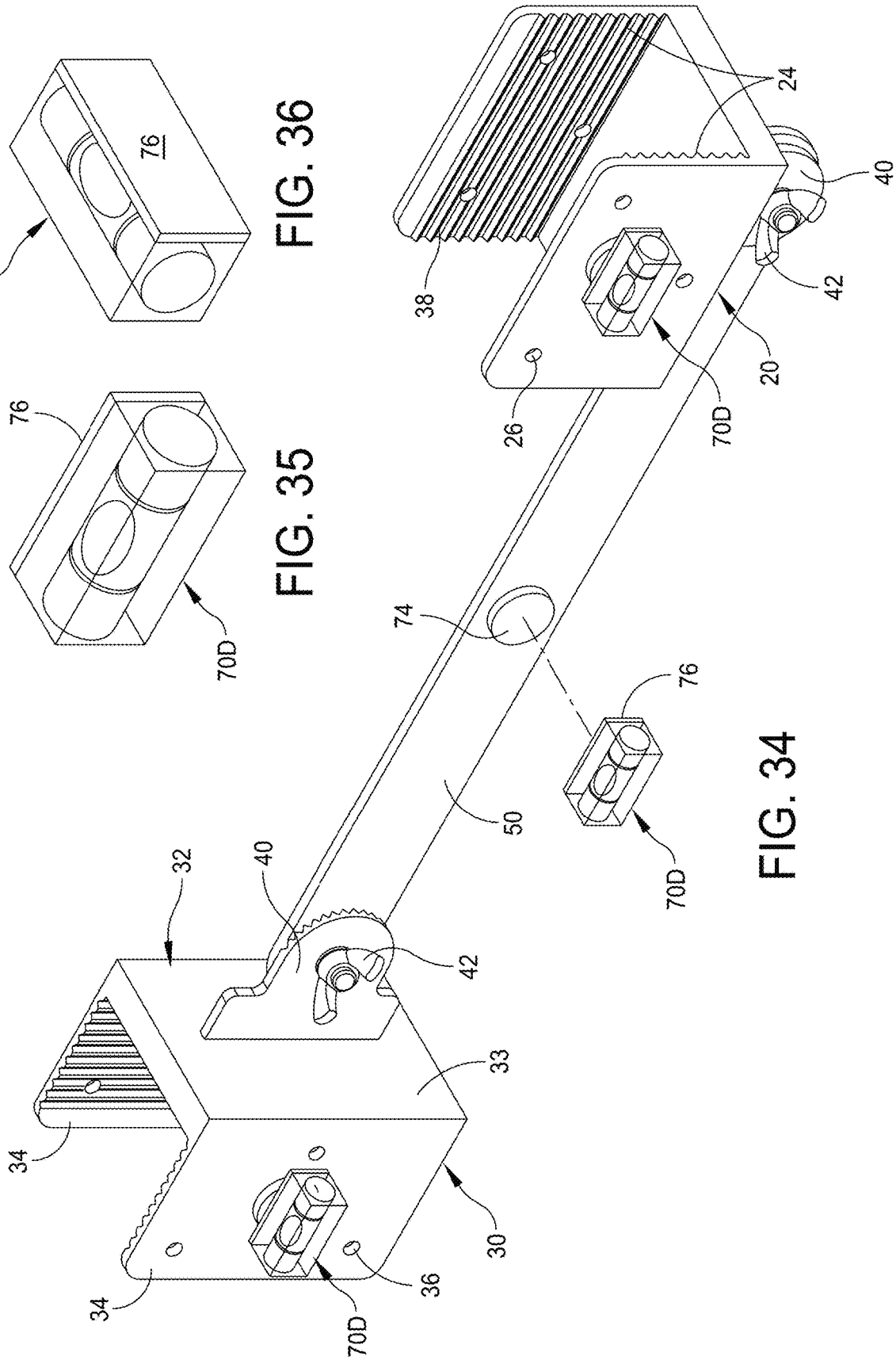
FIG. 34

BEAM SUPPORT STRUCTURE

CROSS-REFERENCE TO RELATED APPLICATIONS

This application is a continuation-in-part (CIP) of U.S. Ser. No. 18/601,298 filed Mar. 11, 2024 which is a continuation-in-part (CIP) of U.S. Ser. No. 18/403,065 filed Jan. 3, 2024 and each of which is incorporated by reference herein in its entirety.

BACKGROUND OF THE INVENTION

The present invention relates in general to a beam support structure and pertains, more particularly, to an improved structure for supporting beams or posts of various types and sizes.

Accordingly, it is an object of the present invention to provide a beam support structure that employs a pair of support brackets for respective beams or posts.

Another object of the present invention is to provide an improved beam support structure that is universal in its use for accommodating beams or posts of different types and sizes.

SUMMARY OF THE INVENTION

To accomplish the foregoing and another objectives of the present invention there is provided a beam support structure that is comprised of:

a first bracket for supporting a first beam;

a second bracket for supporting a second beam;

each of said first and second brackets having a flat surface to receive an edge of a corresponding beam; and an arm having respective ends that connect between the first and second brackets;

said arm being secured between the first and second brackets, while allowing multiple different secured positions between the first and second brackets.

In accordance with other aspects of the present invention each bracket is U-shaped including a base wall that defines the flat surface; each U-shaped bracket also includes opposed side walls; further including a flange supported from the base wall of each bracket; further including a first fastener for securing one end of the arm to the flange of the first bracket and a second fastener for securing an opposite end of the arm to the flange of the second bracket; each fastener is comprised of either a wing nut or nut; the one end of the arm has a flat surface that rests against the base wall; the one end of the arm also rests against the flange; the sidewalls have respective facing surfaces that are grooved to enhance gripping with the beam; the opposite end of the arm is configured to enable rotation between the one end of the arm and the second bracket to provide relative positioning between respective beams that are being supported; each bracket includes one or more holes in the side walls for accommodating nails or screws for securing each bracket to a respective beam; the flange is disposed at a center area of the base wall; or the flange is disposed at a side edge of the base wall.

In accordance with still another version of the present invention there is provided a beam support structure that is comprised of a first bracket for supporting a first beam or post; and a second bracket for supporting a second beam. Each of said first and second brackets are of U-shape including a base wall and a pair of side walls that extend orthogonal to the base wall, and a support flange that extends parallel to the pair of side walls and an arm having respective ends that connect between the respective flanges of the first and second brackets. The arm is secured between the first and second brackets, while allowing multiple different secured positions between the first and second brackets.

In accordance with other aspects of the present invention further including a first fastener for securing one end of the arm to the flange of the first bracket and a second fastener for securing an opposite end of the arm to the flange of the second bracket; each fastener is comprised of either a wing nut or nut; the one end of the arm has a flat surface that rests against the base wall; and the one end of the arm also rests against the flange.

In still another embodiment of the present invention there is provided a beam support structure that is comprised of a first bracket for supporting a first beam or post; and a second bracket for supporting a second beam. Each of said first and second brackets is of U-shape including a base wall and a pair of side walls that extend orthogonal to the base wall, and a support flange that extends parallel to the pair of side walls. The pair of side walls extend in an opposite direction to the flange for both brackets; and further including an arm having respective ends that connect between the respective flanges of the first and second brackets. The arm is secured between the first and second brackets by respective fasteners; wherein the one end of the arm has a flat surface that rests against the base wall, and wherein the one end of the arm also rests against the flange. The flat surface engages a major section of a width of the bracket.

In accordance with a further feature of the present invention, leveling members are associated with the bracket structure. These leveling members may be in the form of an "air bubble" level, a "digital" level, and may be supported by a clip structure or a magnetic means.

BRIEF DESCRIPTION OF DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 34 is a front perspective view of the post and beam support of the present invention in which there is provided a leveling member that may be comprised of an air bubble level attached by a magnetic means;

FIG. 35 is a front perspective view showing the leveling member of FIG. 34;

FIG. 36 is a rear perspective view of the leveling member of FIG. 34.

DETAILED DESCRIPTION OF THE INVENTION

The purpose of the beam support structure of the present invention is to provide either a temporary or permanent support between beam or post members. In a preferred embodiment of the present invention, its purpose is to provide a temporary support. The beam or post may be constructed of wood or other material such as aluminum.

Figure 16:
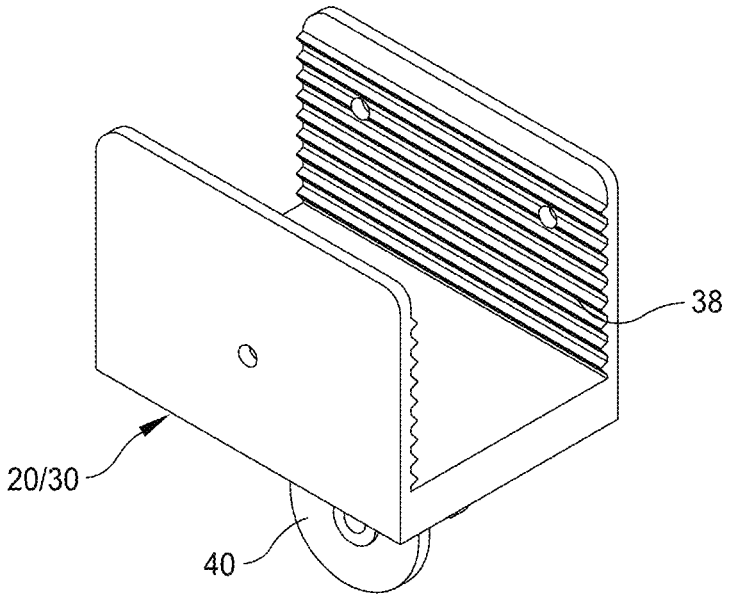
FIG. 16 is a bottom perspective view of a second embodiment of the bracket.
Figure 19:
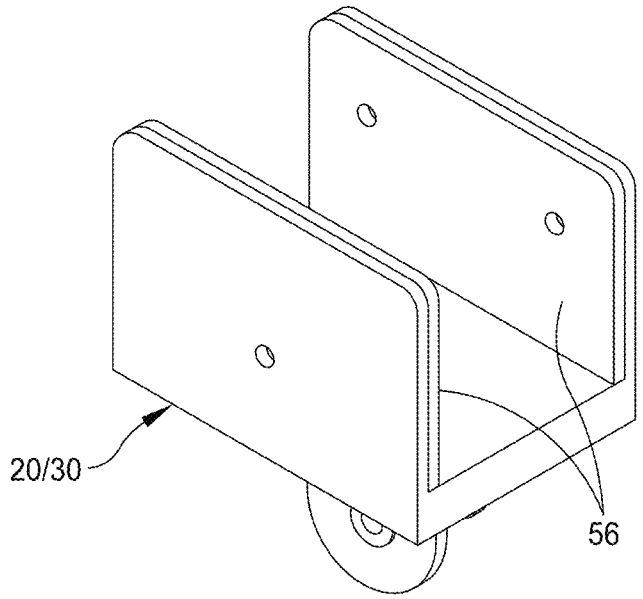
FIG. 19 is a bottom perspective view of a third embodiment of the bracket employing an inner gasket.
Figure 20:
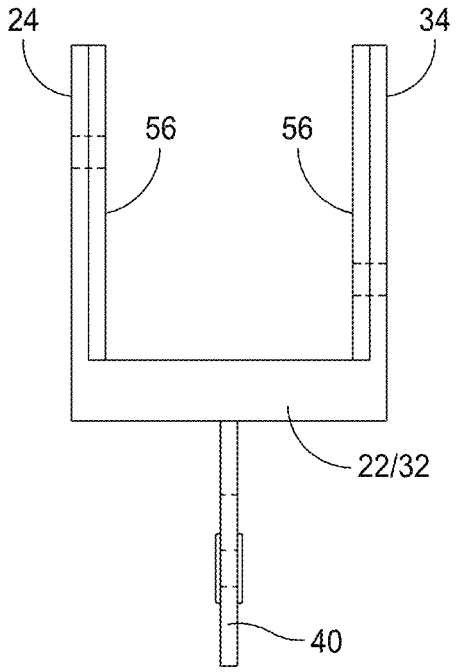
FIG. 20 is a side view of the bracket of FIG. 19.
Figure 21:
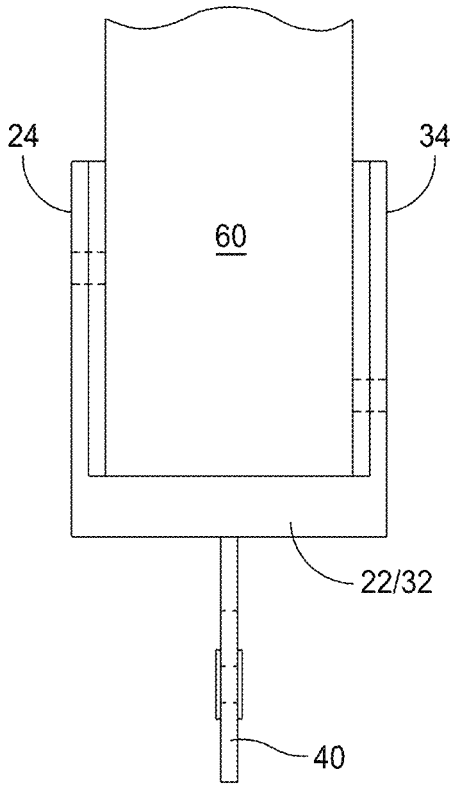
FIG. 21 is a side view similar to that in FIG. 20 and showing a beam being supported.
Figure 22:
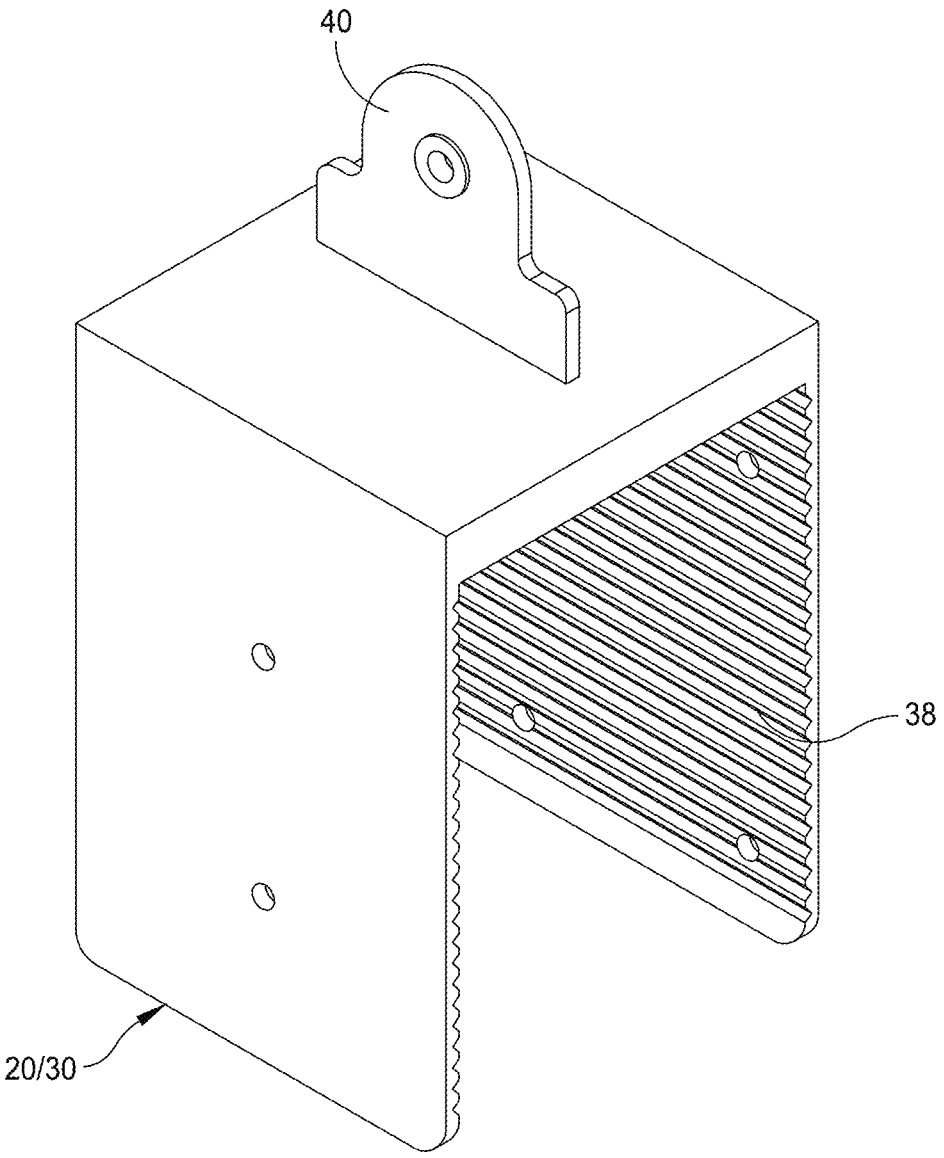
FIG. 22 is a top perspective view of a fourth embodiment for accommodating a larger beam or post.

The beam support structure illustrated in the drawings can be used at a site where construction occurs and can be used to assist as a temporary support for structural modifications. The u-shaped channel formed by the bracket has holes in each horizontal side wall that allows screws to secure the post or beam within the channel. In the drawings illustrated herein, each of the brackets 20/30 may be constructed in different sizes including different widths and different depths. Refer, for example, to FIGS. 16 and 22. In this connection, even when a wider bracket is used spacers of some type such as of rubber or wood may be used to fill in any excess gaps. In that case, longer screws are employed to attach securely to the beam or post. In one embodiment described herein in FIGS. 19-21, a gasket 56 is used as illustrated.

Figure 10:
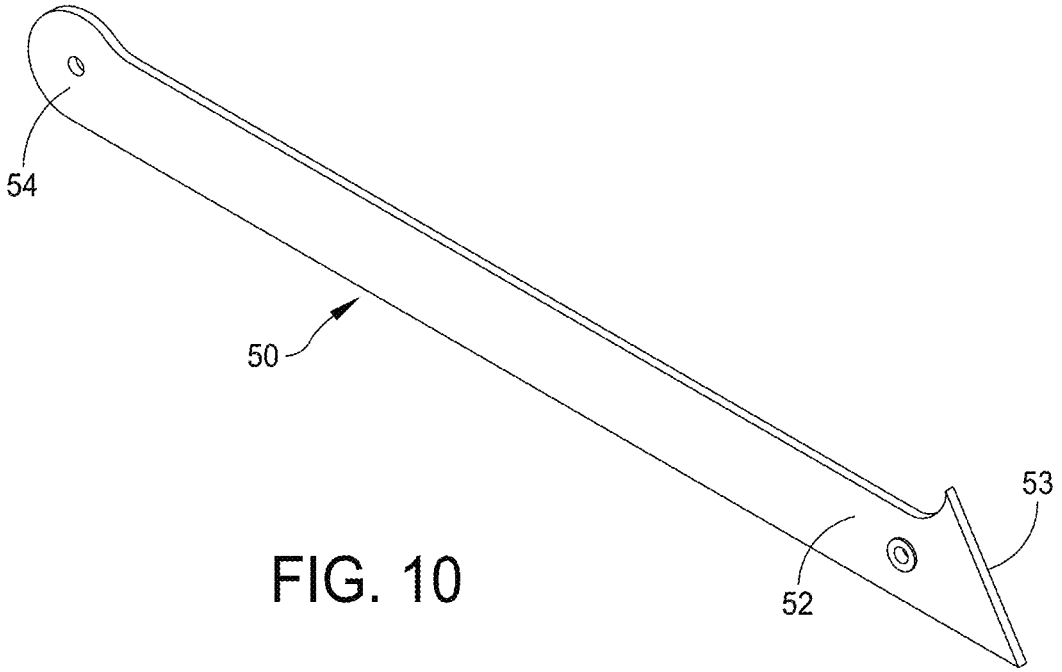
FIG. 10 is a front perspective view of the support arm.
Figure 11:
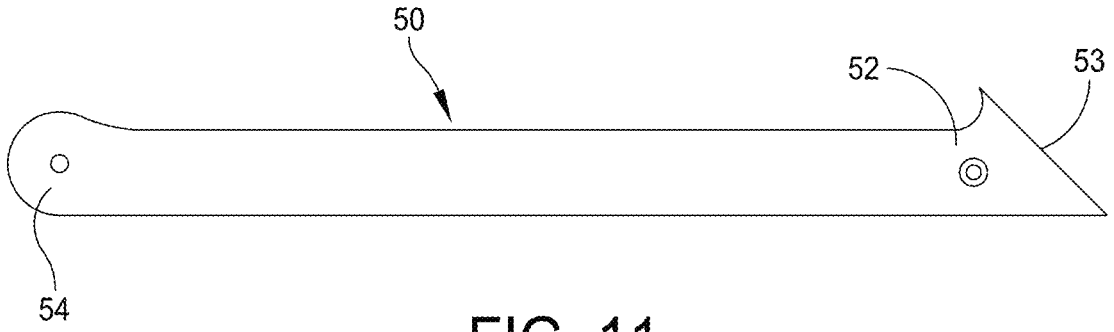
FIG. 11 is a front view of the support arm.

Also, in accordance with the present invention, the construction of the interconnecting arm 50 is important. The arm 50 is secured to respective flanges 40 by means of wing nuts or conventional nuts. As illustrated in FIGS. 10 and 11, one end of the arm 50 is provided with a flat surface 53 that buts against the base wall 22/32 of the bracket. This flat wall contact is important to allow a proper weight distribution. At the same time, the other bracket 30 is secured to its flange by means of a fastener that allows a pivoting action through several degrees; at least through 90 degrees.

An objective of the present invention is to provide a beam support structure that is designed to assist in faster and more efficient ways to join posts or beams both in connection with new construction work as well as modifications to existing structures.

Reference is now made to the drawings. There is provided a beam support structure 10 that is comprised of a first bracket 20 for supporting a first beam 60A. At the opposite end of the beam support structure there is a second bracket 30 for supporting a second beam 60B. In this regard refer to FIG. 12 that shows the positions of the brackets 20 and 30 and the corresponding beams 60A and 60B.

Figure 12:
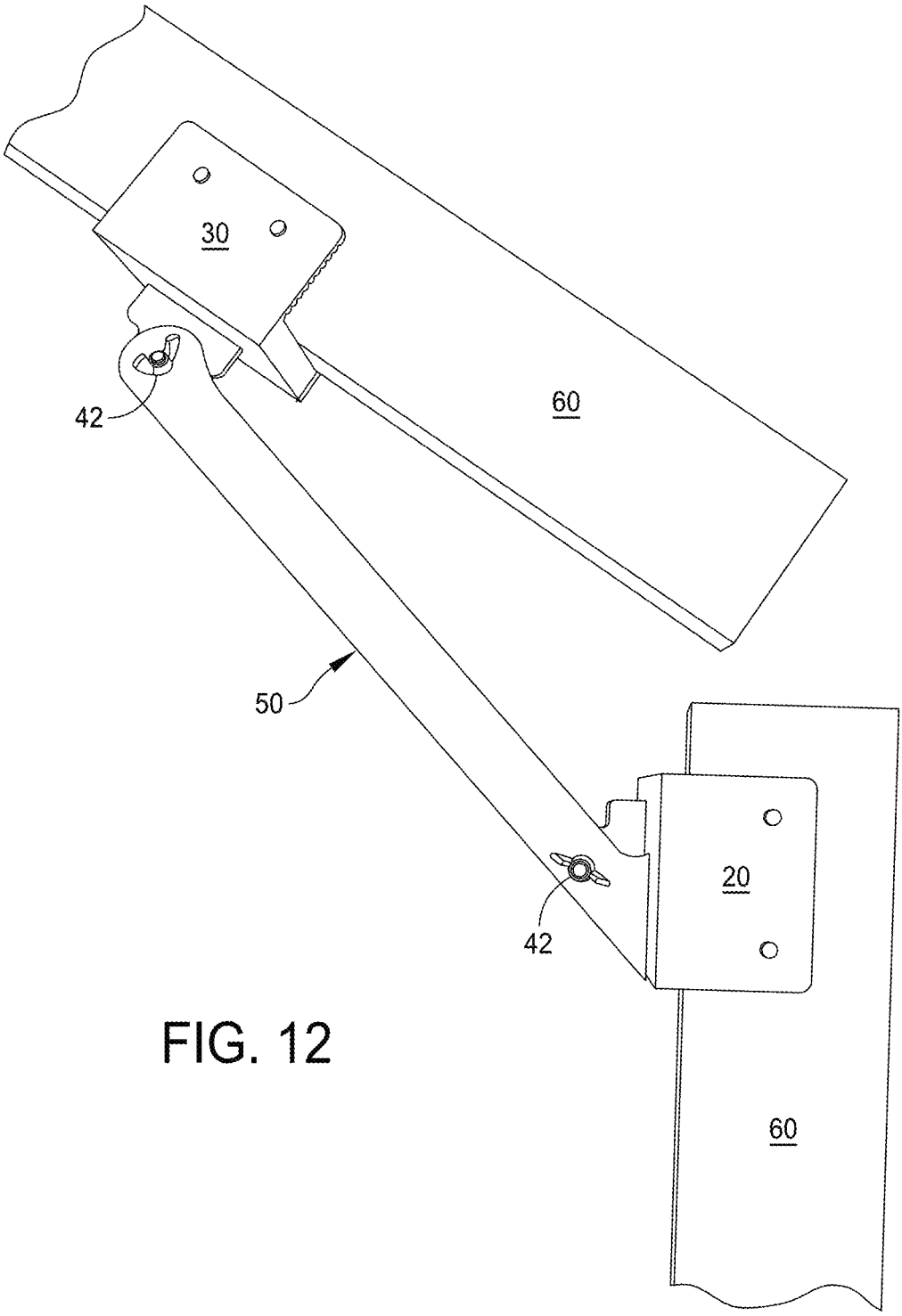
FIG. 12 is a perspective view illustrating the beam support structure further illustrating the beams or posts.
Figure 13:
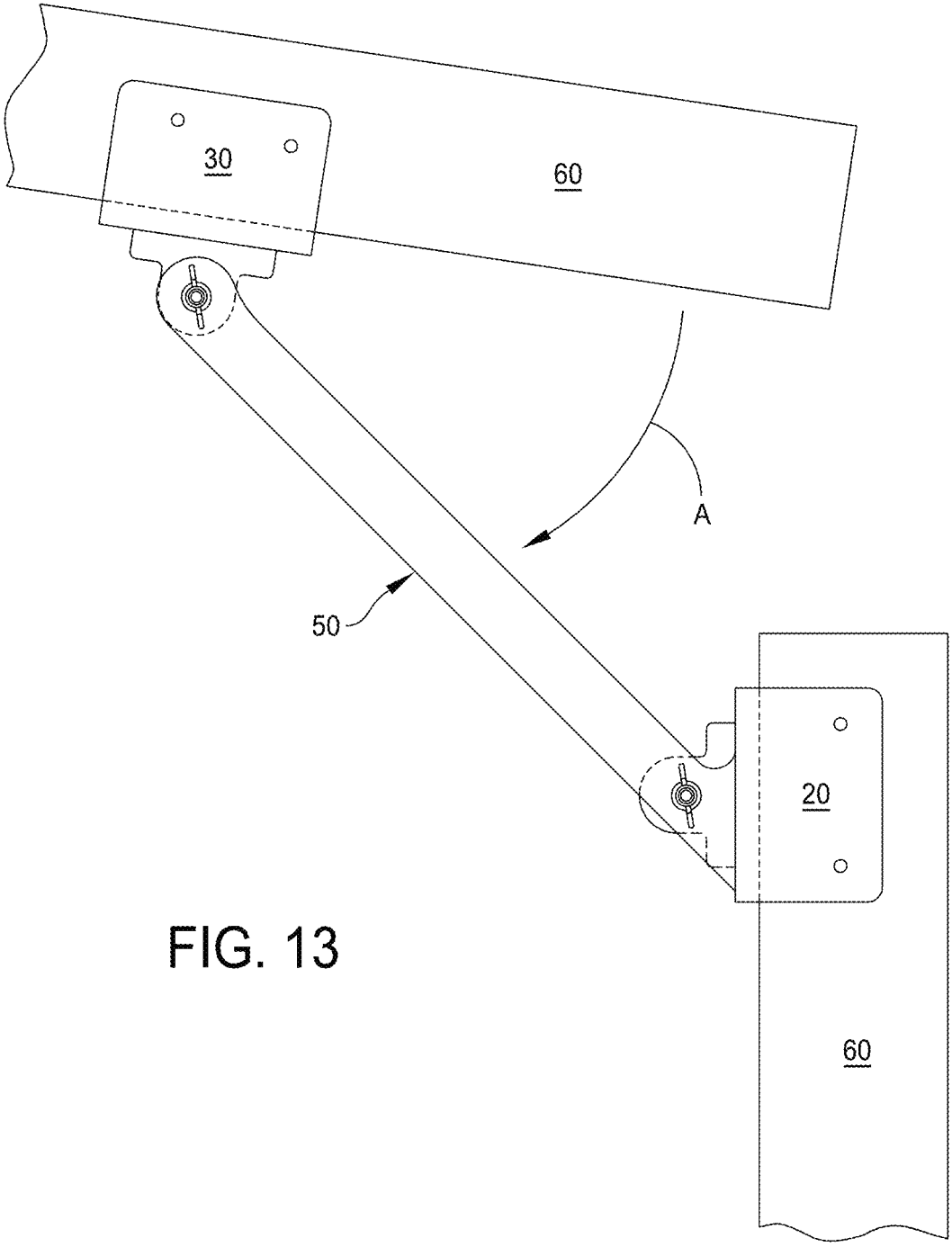
FIG. 13 is a front view of the beam support structure illustrating the manner in which the location of one of the beams can be adjusted.
Figure 14:
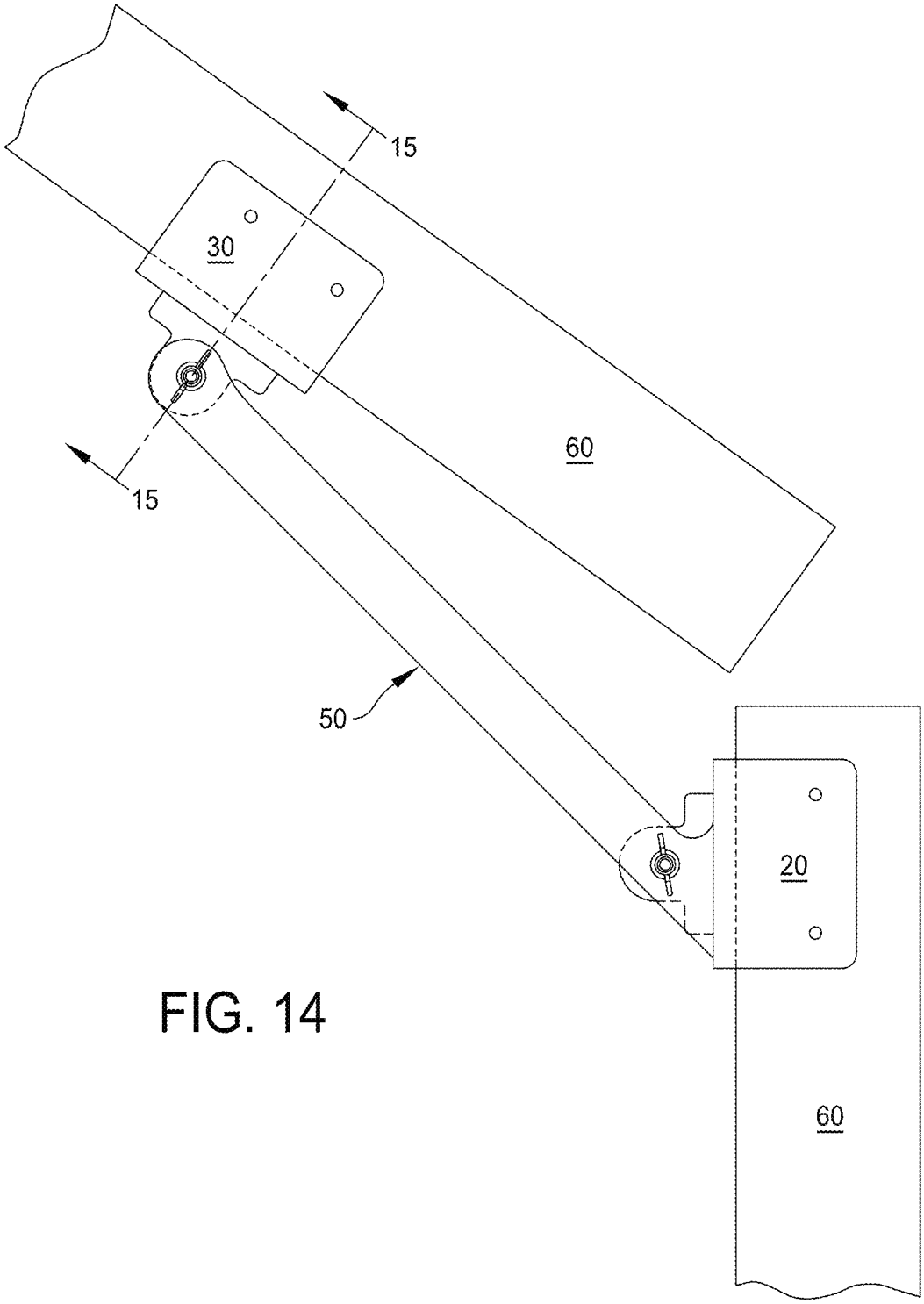
FIG. 14 is a front view of the beam support structure illustrated in another position.

Each of the first and second brackets have a flat surface 23/33 to receive a side of a corresponding beam. The beam support structure also is comprised of an arm 50 having respective ends 52 and 54 that connect with the respective brackets 20 and 30. Once the beams are in the proper position, the arm can be locked in place. Reference may be made to FIGS. 12-14 to show different relative positions. The arrow A in FIG. 13 illustrates the manner in which a pivoting action can occur of the beam 60B. At the same time because of the flat surface 53 of the arm 50, the relative angular position is fixed between the arm 50 and the bracket 20. Again, refer to FIGS. 12-14. In all of the positions illustrated, the bracket 20 is in the same position.

Figure 15:
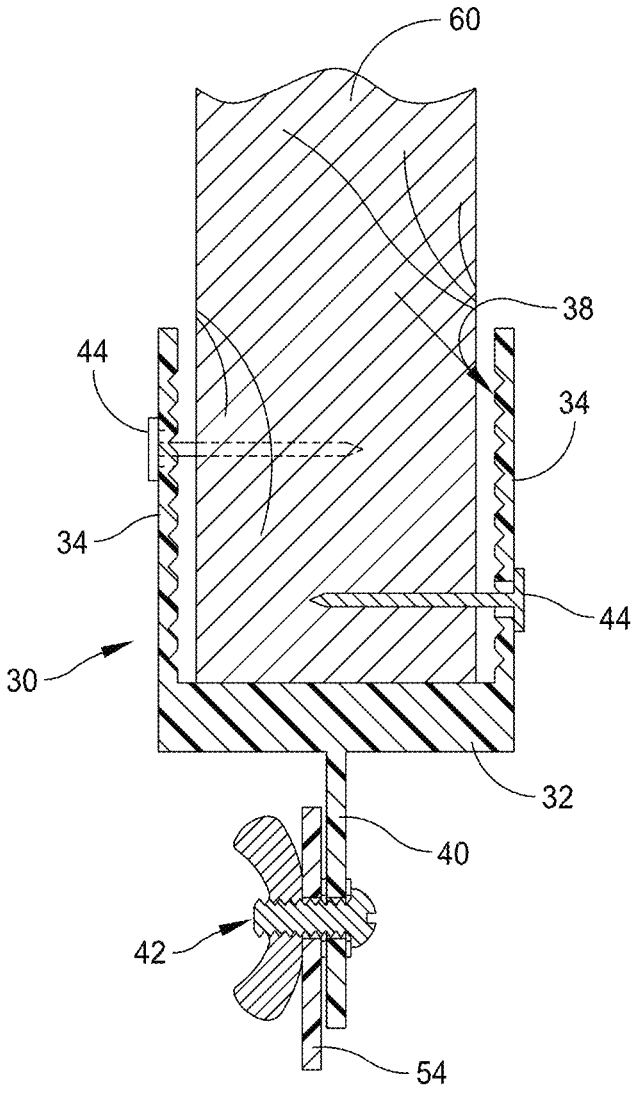
FIG. 15 is a cross-sectional view taken along line 15-15 of FIG. 14.

Thus, each of the brackets 20 and 30 is basically u-shaped including a base wall 22/32 that defines a flat surface. Each of the brackets 20 and 30 also include opposed side walls 24/34. In order to attach the arm 50 to each of the brackets, each of the brackets includes a flange 40 supported from its corresponding base wall. Fasteners are employed for permanently or temporarily securing each bracket with the beam or post. In this regard, refer to the cross-section view of FIG. 15 which shows nails 44. FIG. 15 also illustrates a bracket fastener 42 in the form of a screw and wing nut. Any other types of fasteners may be employed for connecting the elongated arm 50 with the respective end brackets 20 and 30.

Figure 17:
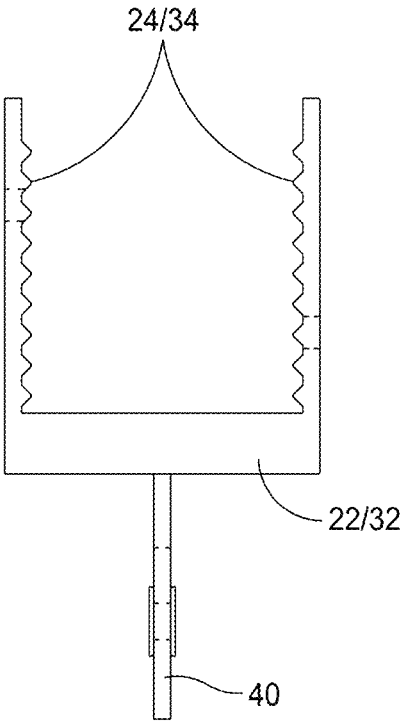
FIG. 17 is a side view of the bracket of FIG. 16.
Figure 18:
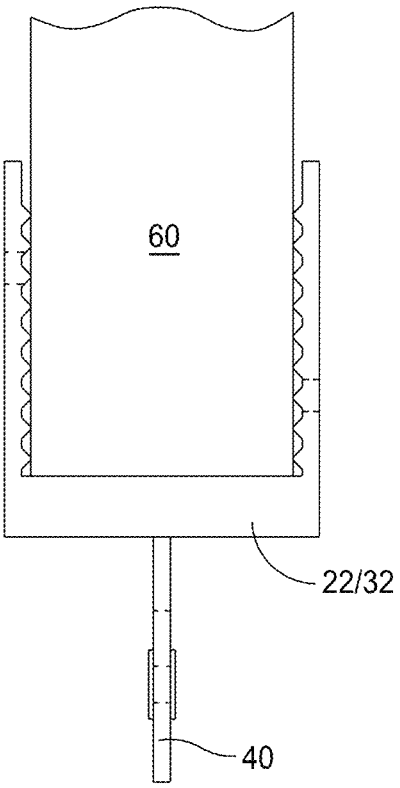
FIG. 18 is a side view similar to that illustrated in FIG. 17 and showing the gripping action with a beam.

The drawings also illustrate that the side walls of the bracket preferably have grooved surfaces at 38 to enhance the gripping action between the bracket and the beam or post. In this regard refer to FIGS. 16-18. FIG. 18 in particular shows how the surface at 38 interacts with the beam 60.

Thus, one end 52 of the arm has the flat surface 53 that rests against the base wall of bracket 20. The opposite end 54 of the arm 50 is configured to enable rotation between the end 54 of the arm and the bracket 30. Once again, reference is made to FIGS. 12-14 for showing the various positions that can be obtained.

Figure 23:
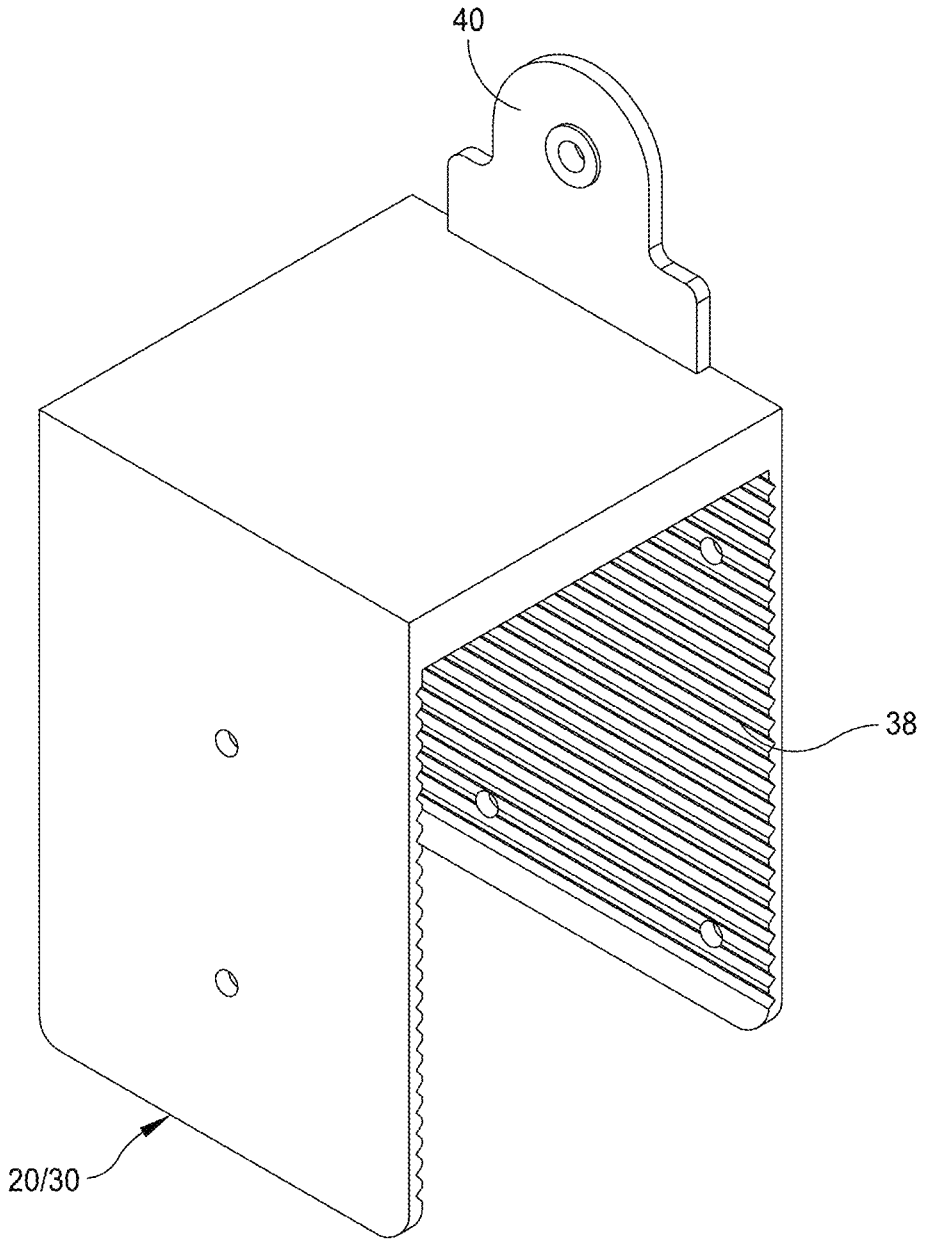
FIG. 23 is a view similar to that illustrated in FIG. 22 but showing the bracket flange in a different position.

FIGS. 22 and 23 simply illustrate a further embodiment in which the bracket is deeper in construction. In this embodiment of the bracket, there is also provided the roughened surface 38. In FIG. 22 the flange 40 is disposed at a midpoint of the wall of the bracket while in FIG. 23 the flange 40 is disposed at a side edge of the base wall. There may be instances where the construction of FIG. 23 is preferred.

Figure 2:
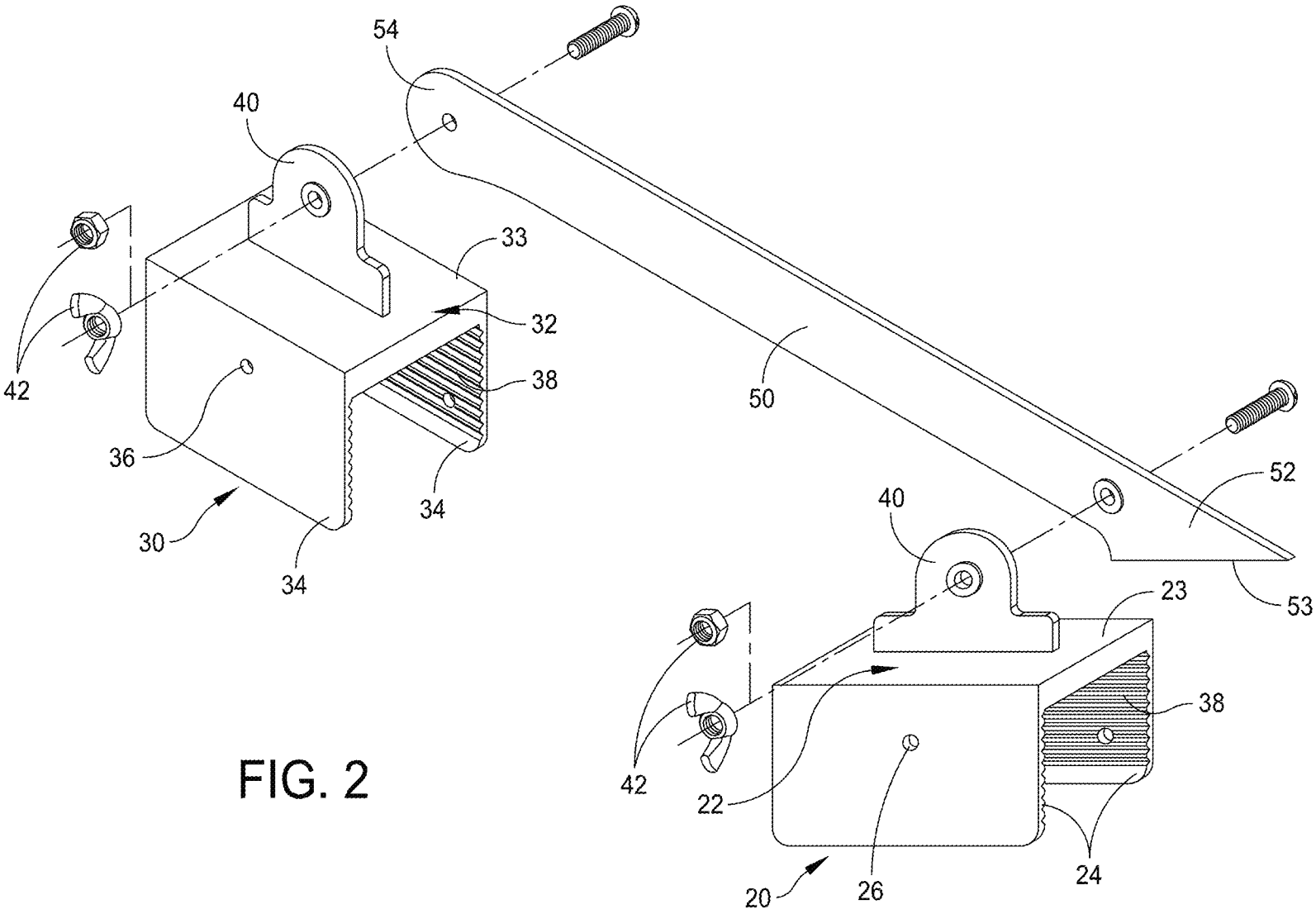
FIG. 2 is an exploded perspective view of the beam support structure of FIG. 1.
Figure 3:
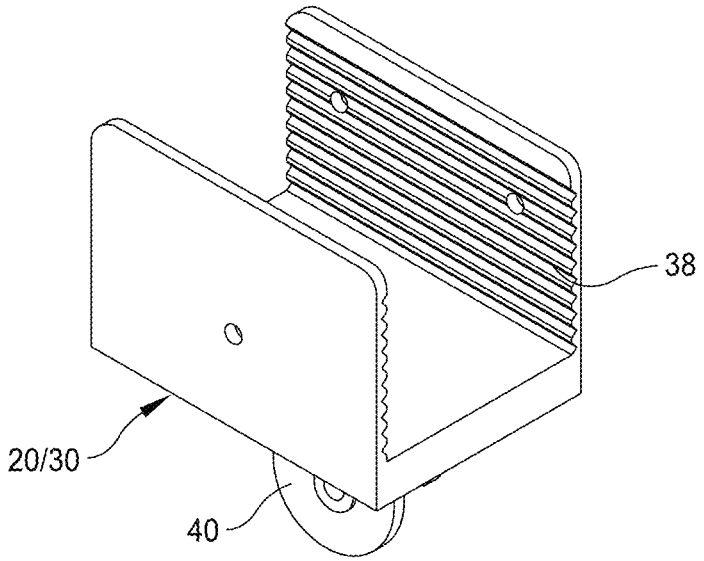
FIG. 3 is a bottom perspective view of the bracket.
Figure 4:
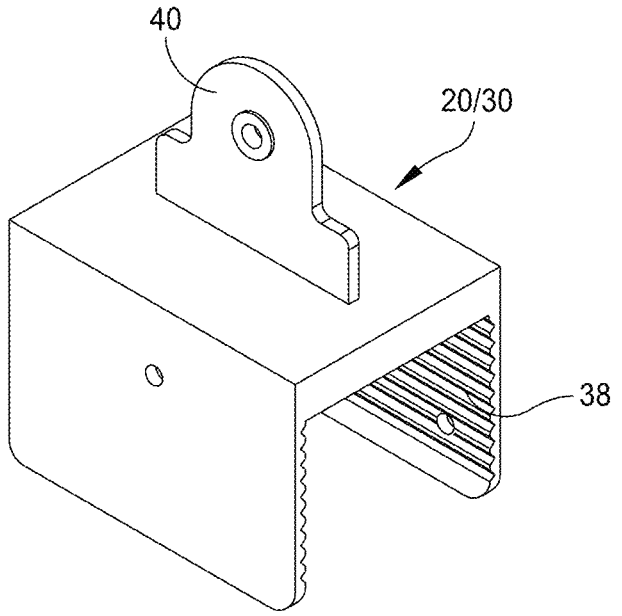
FIG. 4 is a top perspective view of the bracket.
Figure 5:
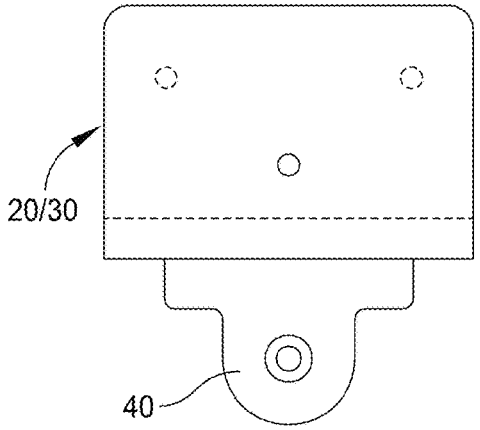
FIG. 5 is a front view of the bracket.
Figure 6:
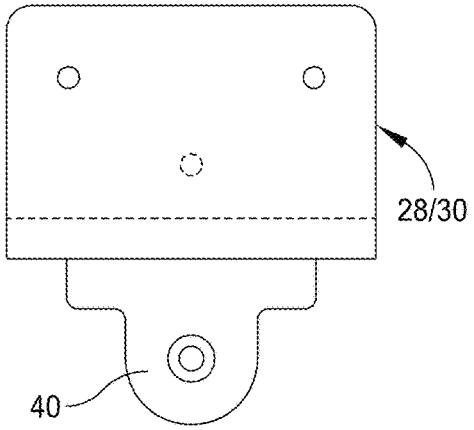
FIG. 6 is a rear view of the bracket.
Figure 7:
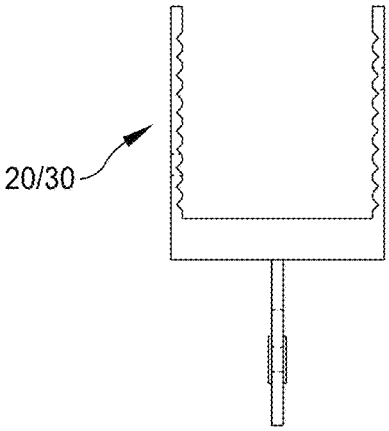
FIG. 7 is a side view of the bracket.
Figure 8:
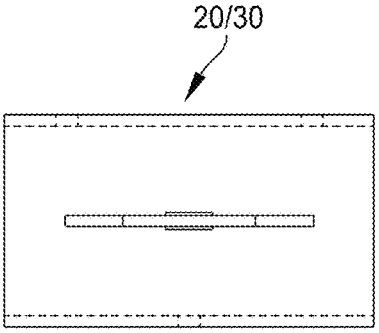
FIG. 8 is a top view of the bracket.
Figure 9:
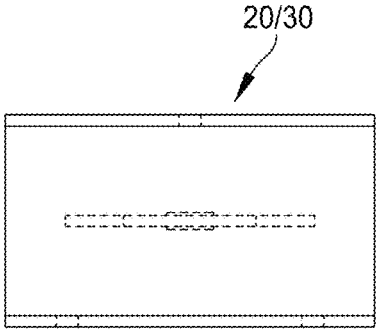
FIG. 9 is a bottom view of the bracket.
Figure 24:
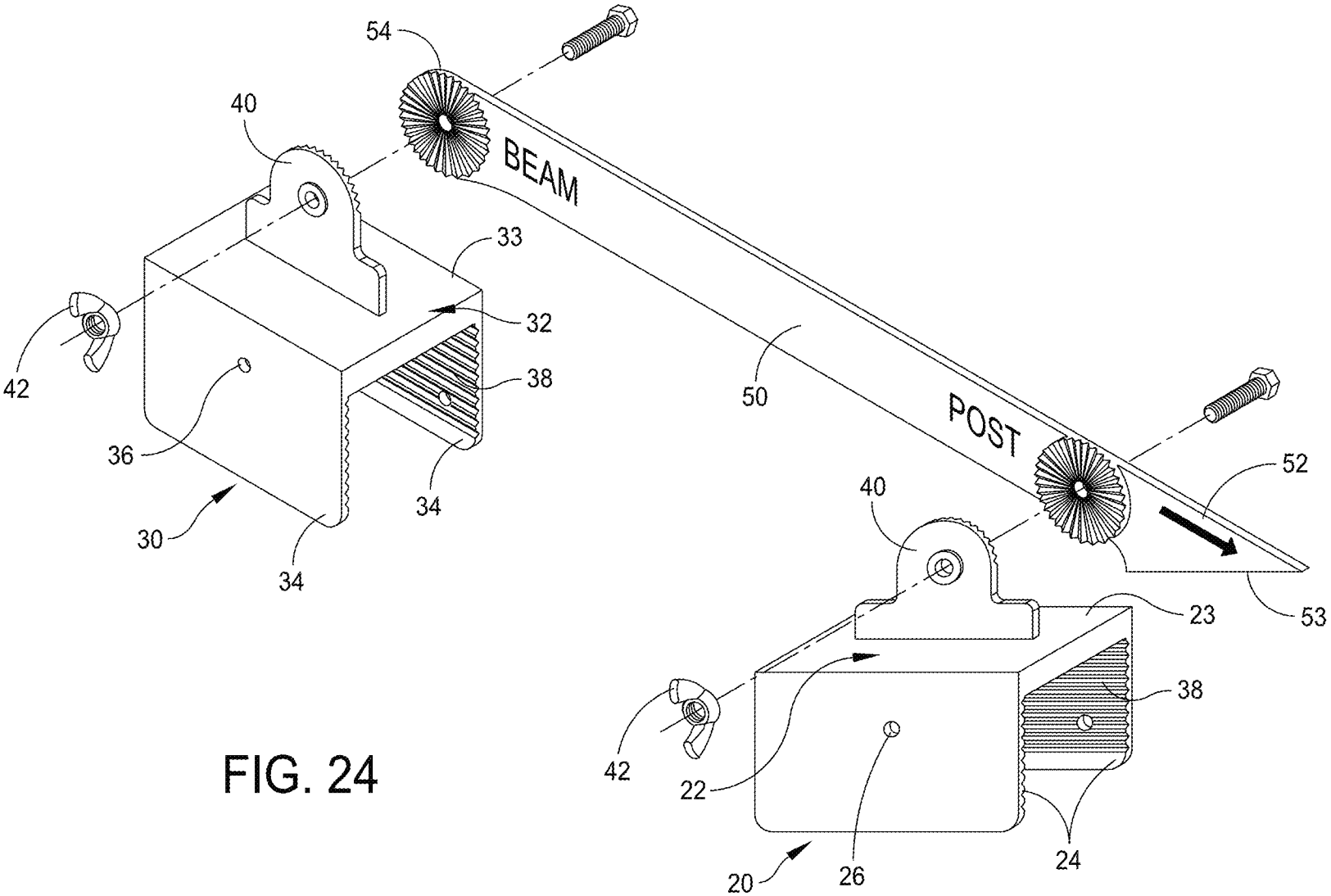
FIG. 24 is a perspective view similar to that illustrated in FIG. 2 but further illustrating a ratchet arrangement at each pivot location.
Figure 25:
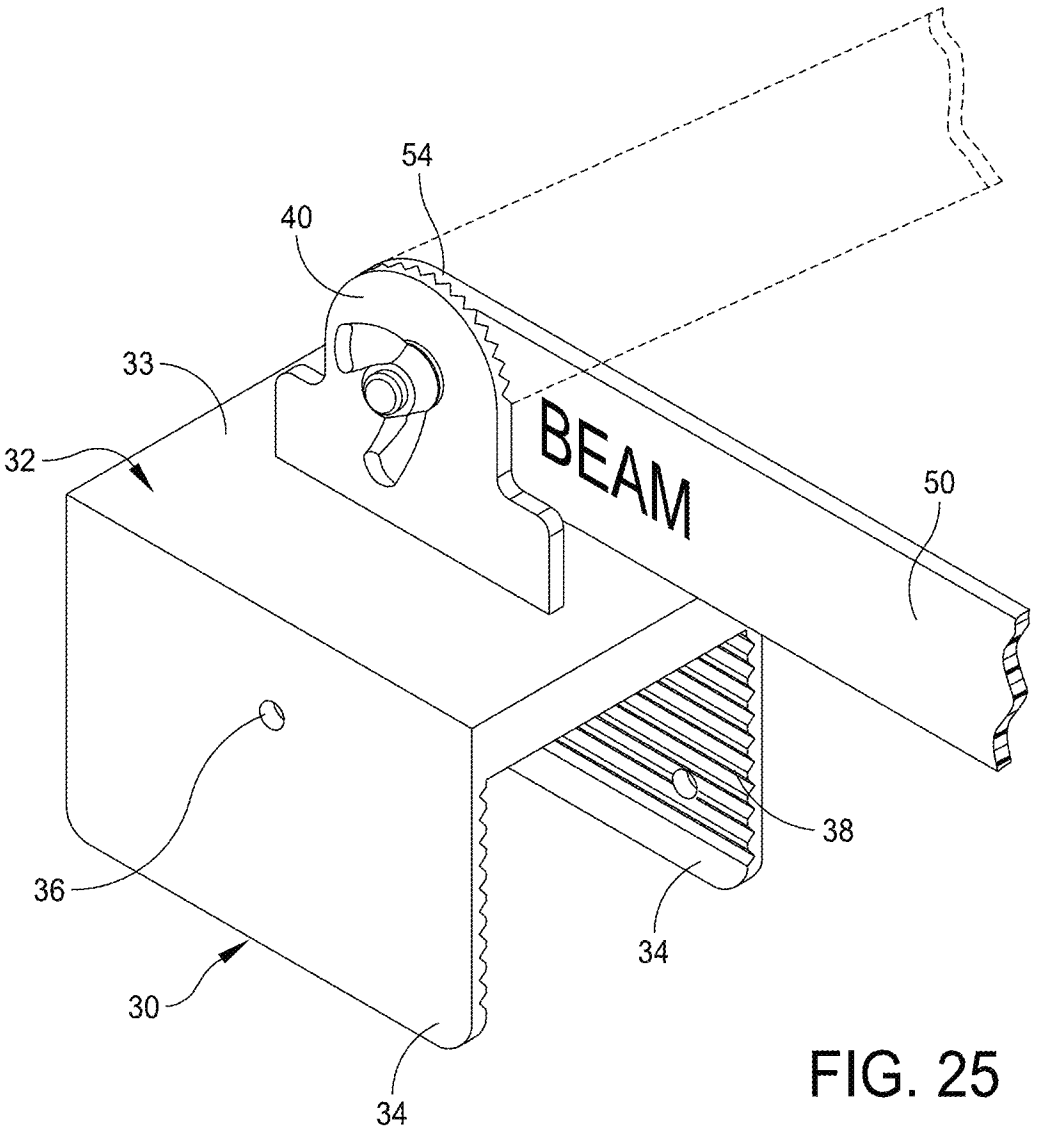
FIG. 25 is a fragmentary perspective view of one of the brackets illustrated in FIG. 24.

FIG. 24 is a perspective view similar to that illustrated in FIG. 2 but further illustrating a ratchet arrangement at each pivot location. FIG. 25 is a fragmentary perspective view of one of the brackets illustrated in FIG. 24. In the embodiment described in FIGS. 24 and 25, a ratchet arrangement is used where interengaging teeth are provided in order to enable several different positions particularly of the bracket 30. The teeth provide for a number of different rotational locations. Once the desired rotation position is attained then the fastener can be tightened. Corresponding like teeth are provided on both the bracket and arm. FIG. 24 also illustrates by the indicia "BEAM" and "POST" where the location of a beam would be supported relative to a post.

Figure 1:
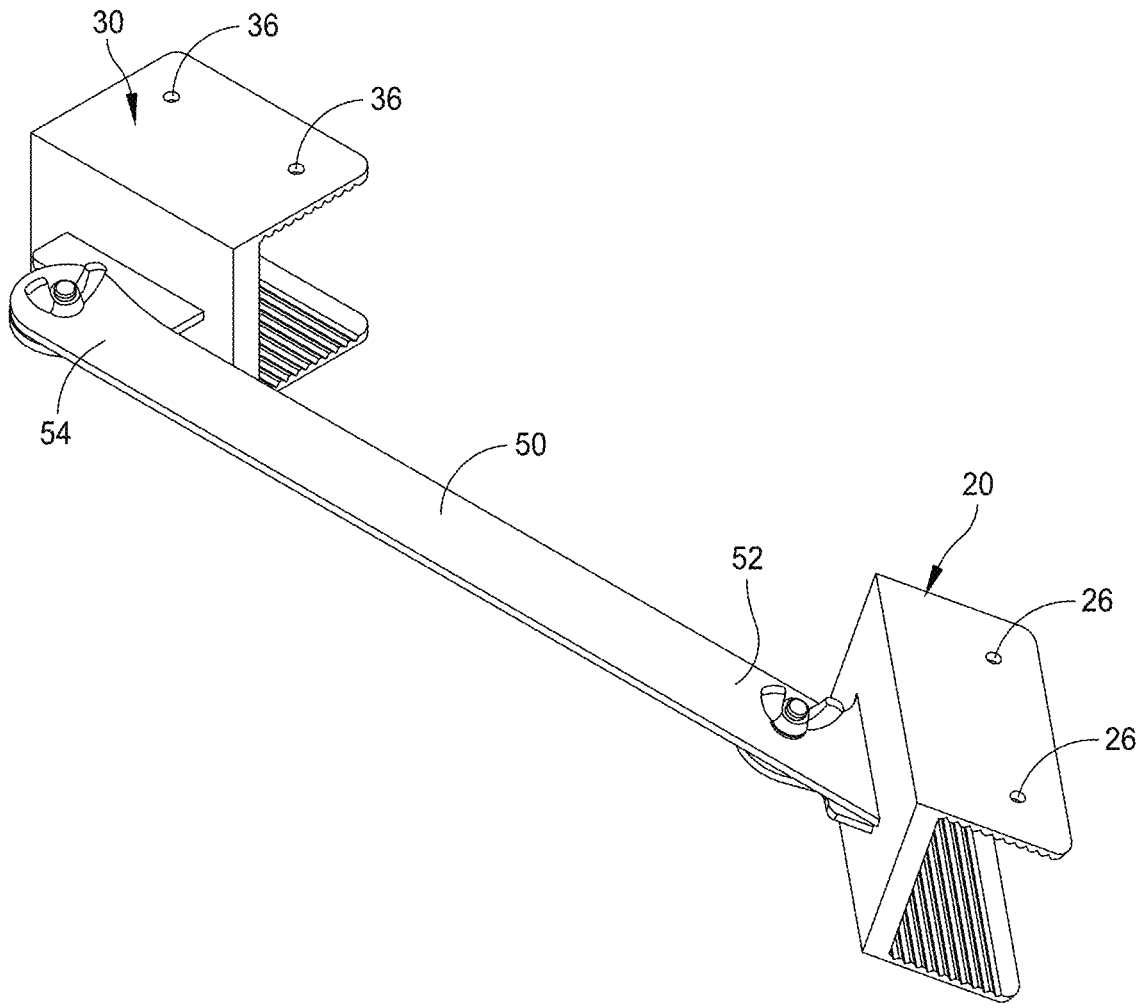
FIG. 1 is a perspective view of the beam support structure.
Figure 26:
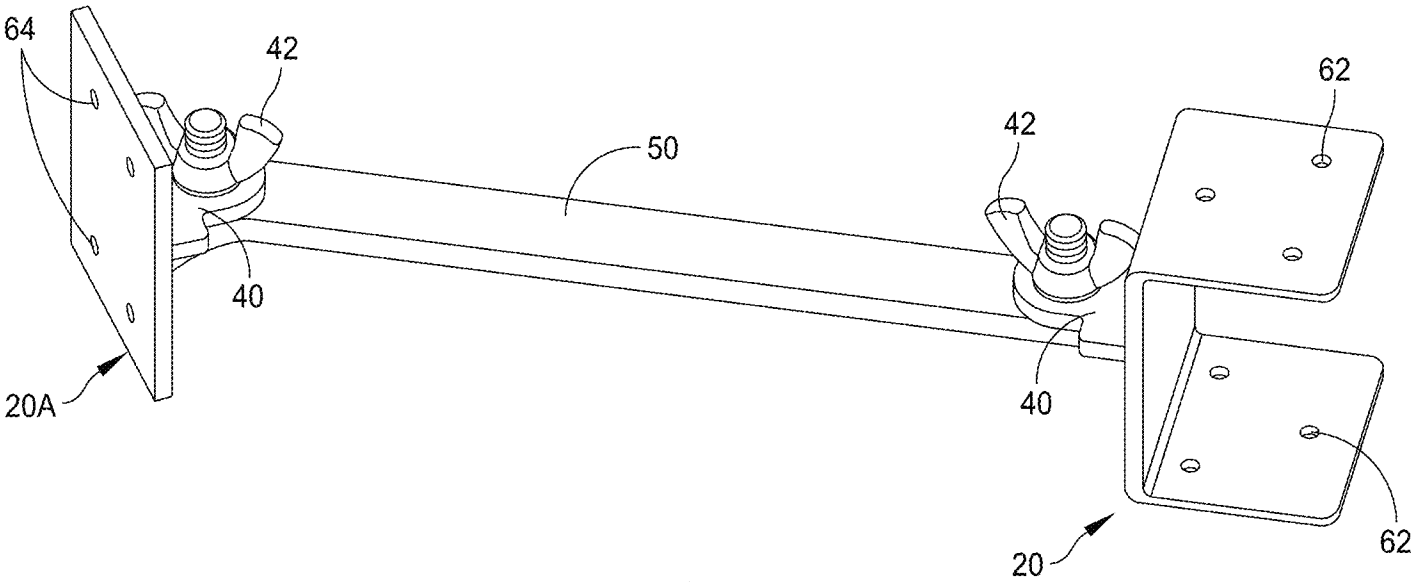
FIG. 26 is a perspective view similar to that illustrated in FIG. 1 and illustrating at one end of the arm a U-shaped bracket and at the other end of the arm a flat plate.

FIG. 26 is a perspective view similar to that illustrated in FIG. 1 and illustrating at one end of the arm a U-shaped bracket and at the other end of the arm a flat plate. The purpose of the bracket arrangement illustrated in FIG. 26 is to provide the user a safe, easier and cost effective way of stabilizing a wooden or metal studded wall. In this regard, in FIG. 26 there is illustrated a U-shaped bracket at 20 coupled to the arm 50 at the bracket flange 40. At the opposite end of the arm there is supported at the flange 40 a flat plate. This plate may be ¼ inch thick and have a dimension of 6 inches by 6 inches. The flat plate 20A is meant to be securely fastened to a horizontal floor. The adjustable bracket 20 can then be attached to the wall stud in a secure manner.

The bracket 20 has sidewalls with holes 62 that enable the bracket to secure the wooden stud or post. At the opposite end of the arm 50 there is provided a flat plate 20A. The plate 20A is provided with a series of holes 64. Screws or nails may be provided passing through the holes 64 for securing the plate 20A to a floor surface. With this arrangement there is no need for using a long 2×4 for nailing into a wall stud. The arrangement illustrated in FIG. 26 saves time, money, and reduces any tripping hazard as it does not encroach into the working area.

Figure 27:
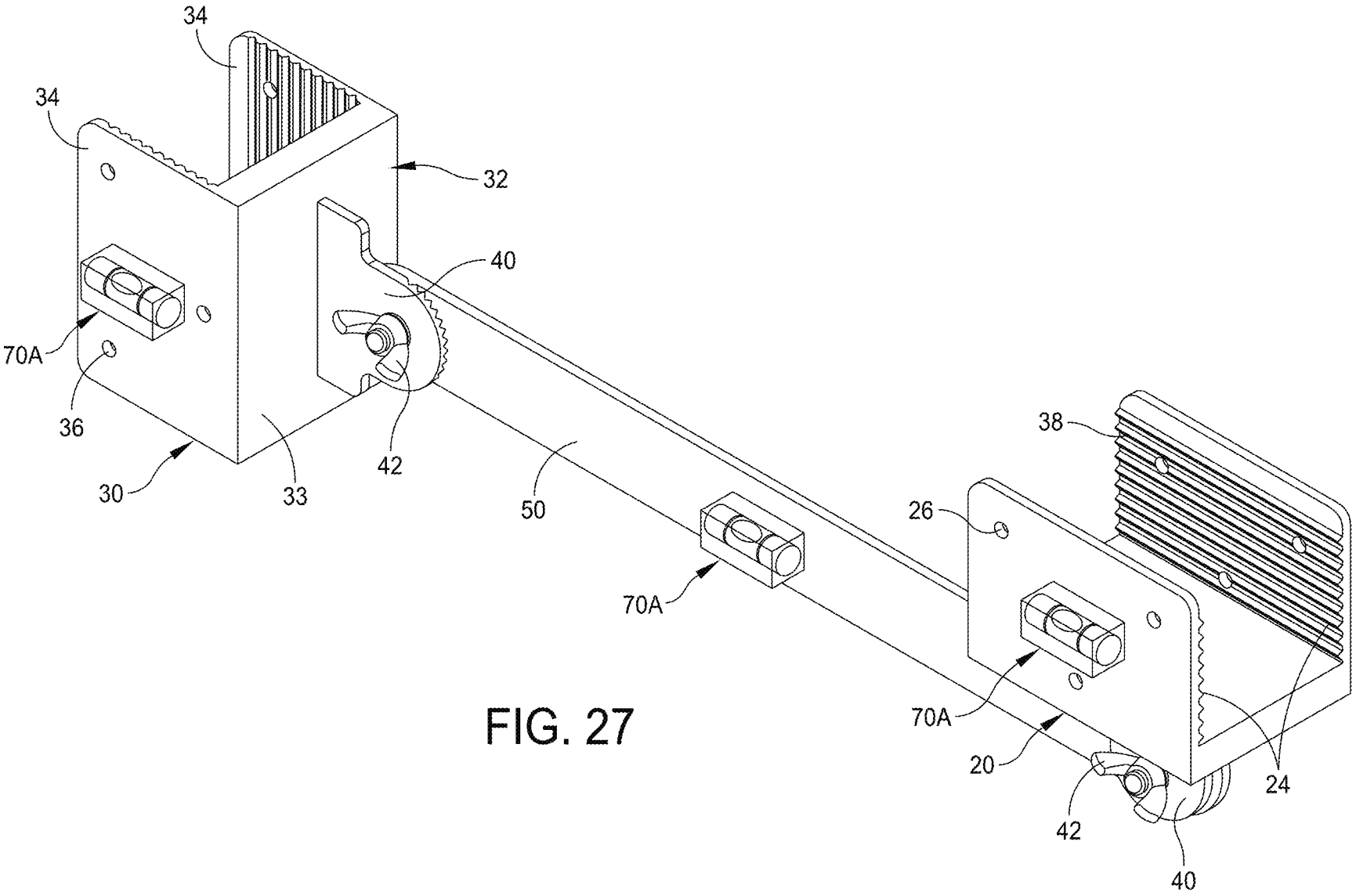
FIG. 27 is a front perspective view of the post and beam support in connection with a further embodiment of the present invention and employing an air bubble level indicator that may be attached or embedded into each bracket as well as the support arm.
Figure 28:
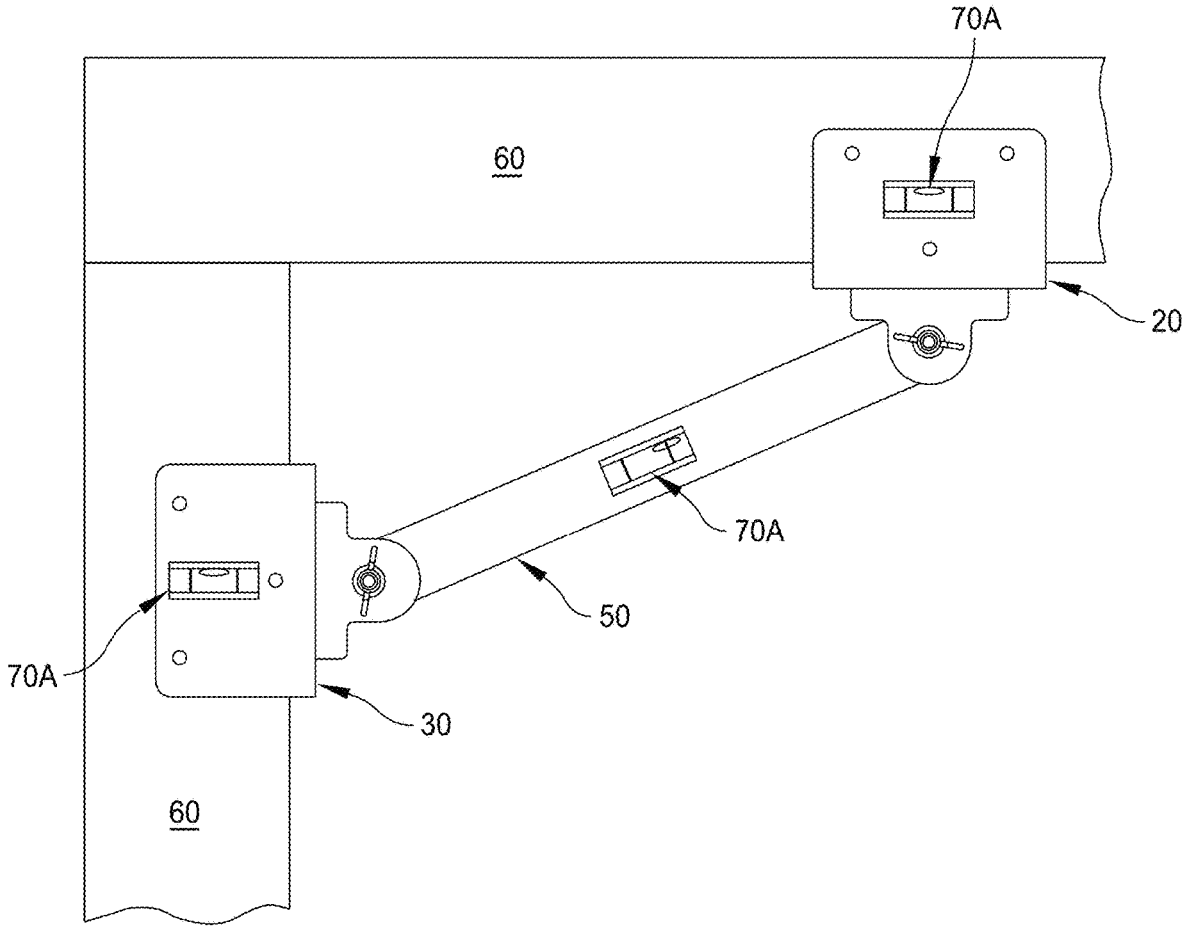
FIG. 28 is a front view of the post and beam support of the embodiment of FIG. 27 showing the air bubble leveling members; one associated with each bracket and as would appear in a "use" position.

FIG. 27 is a front perspective view of the post and beam support in connection with a further embodiment of the present invention and employing an air bubble level indicator that may be attached or embedded into each bracket as well as the support arm. FIG. 28 is a front view of the post and beam support of the embodiment of FIG. 27 showing the air bubble leveling members; one associated with each bracket and as would appear in a "use" position. In the embodiment illustrated in FIGS. 27 and 28 the leveling member 70A is preferably in the form of a small container that rigidly holds an air bubble level in a proper position. The container for the air bubble may be secured in a number of different manners to either the bracket 20/30 or the arm 50. Also in the embodiment illustrated in FIGS. 27 and 28 the leveling member may actually be embedded within the walls of the brackets 20/30 or within the sidewall of the arm 50.

Figure 29:
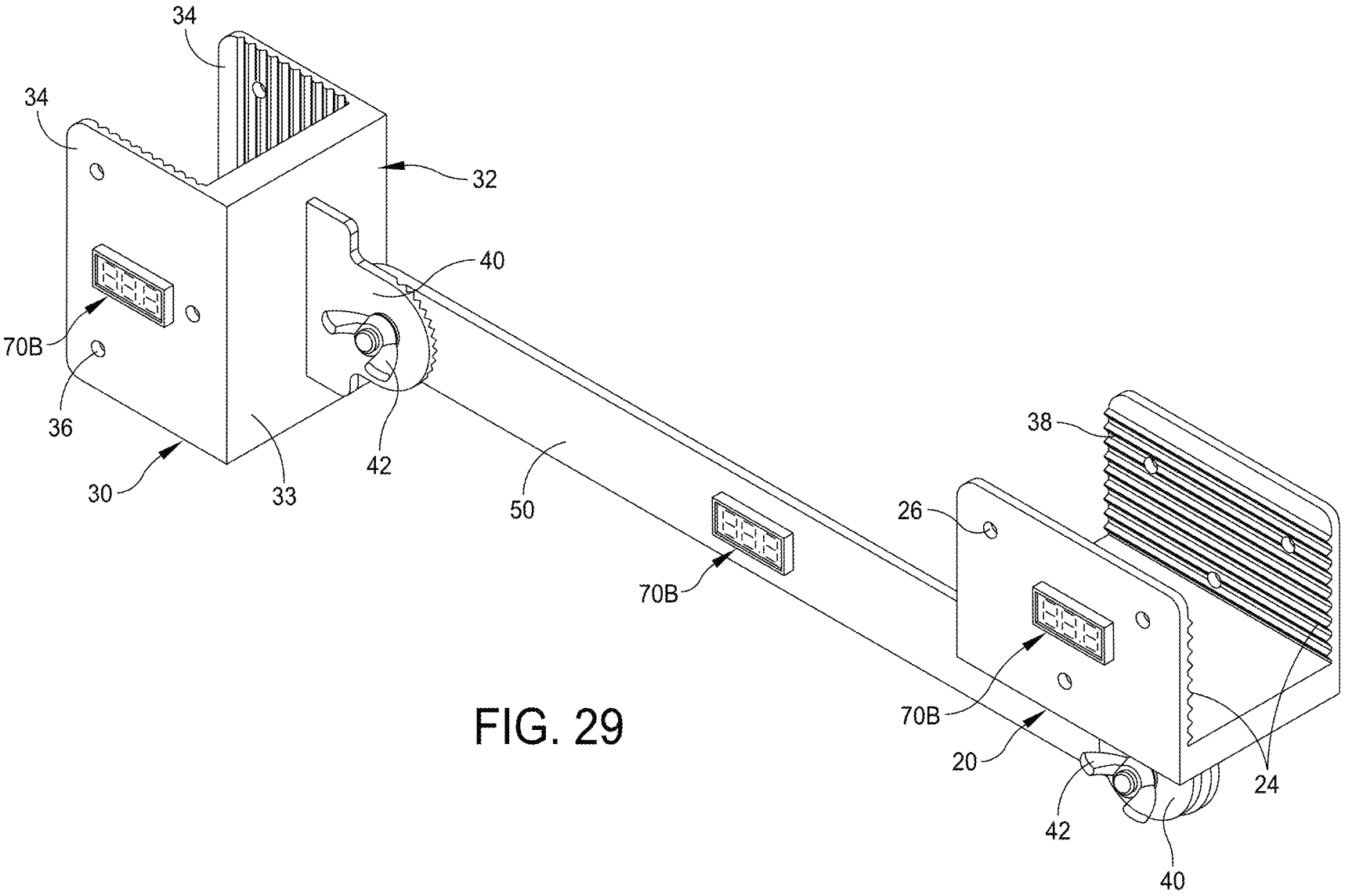
FIG. 29 is a front perspective view of the post and beam support illustrating a different embodiment of the leveling member as attached to the brackets and support arm.
Figure 30:
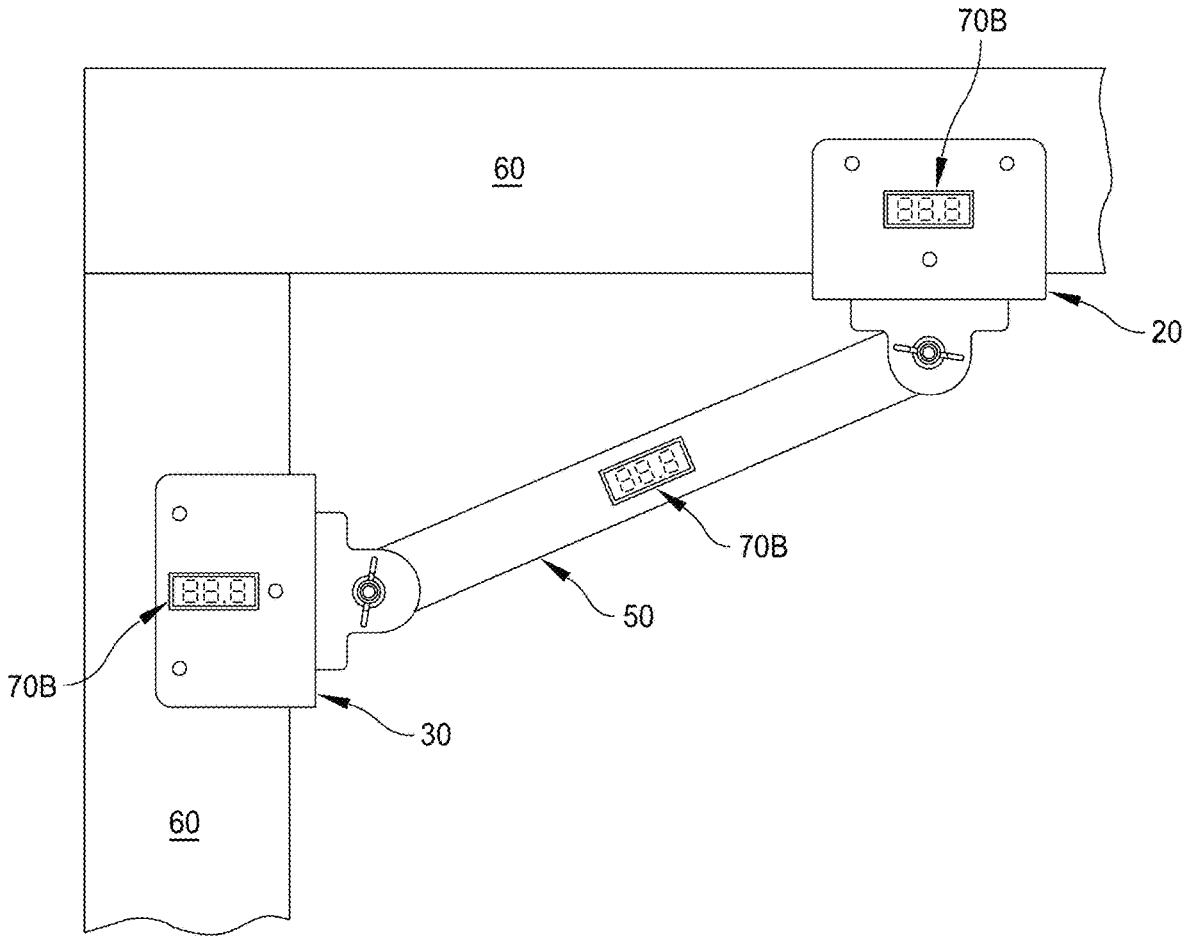
FIG. 30 is a front view of the post and beam support as described in FIG. 29.

FIG. 29 is a front perspective view of the post and beam support illustrating a different embodiment of the leveling member as attached to the brackets and support arm. FIG. 30 is a front view of the post and beam support as described in FIG. 29. In the embodiment illustrated in FIGS. 29 and 30 the leveling member 70B is in the form of a "digital" level. FIGS. 29 and 30 illustrate the leveling member 70B as being attached to a sidewall of each bracket as well as to the side of the arm 50. In this "digital" version, the leveling member may be secured to a sidewall by any conventional means such as by being glued or otherwise secured to the brackets 20/30 and arm 50.

Figures 31, 32:
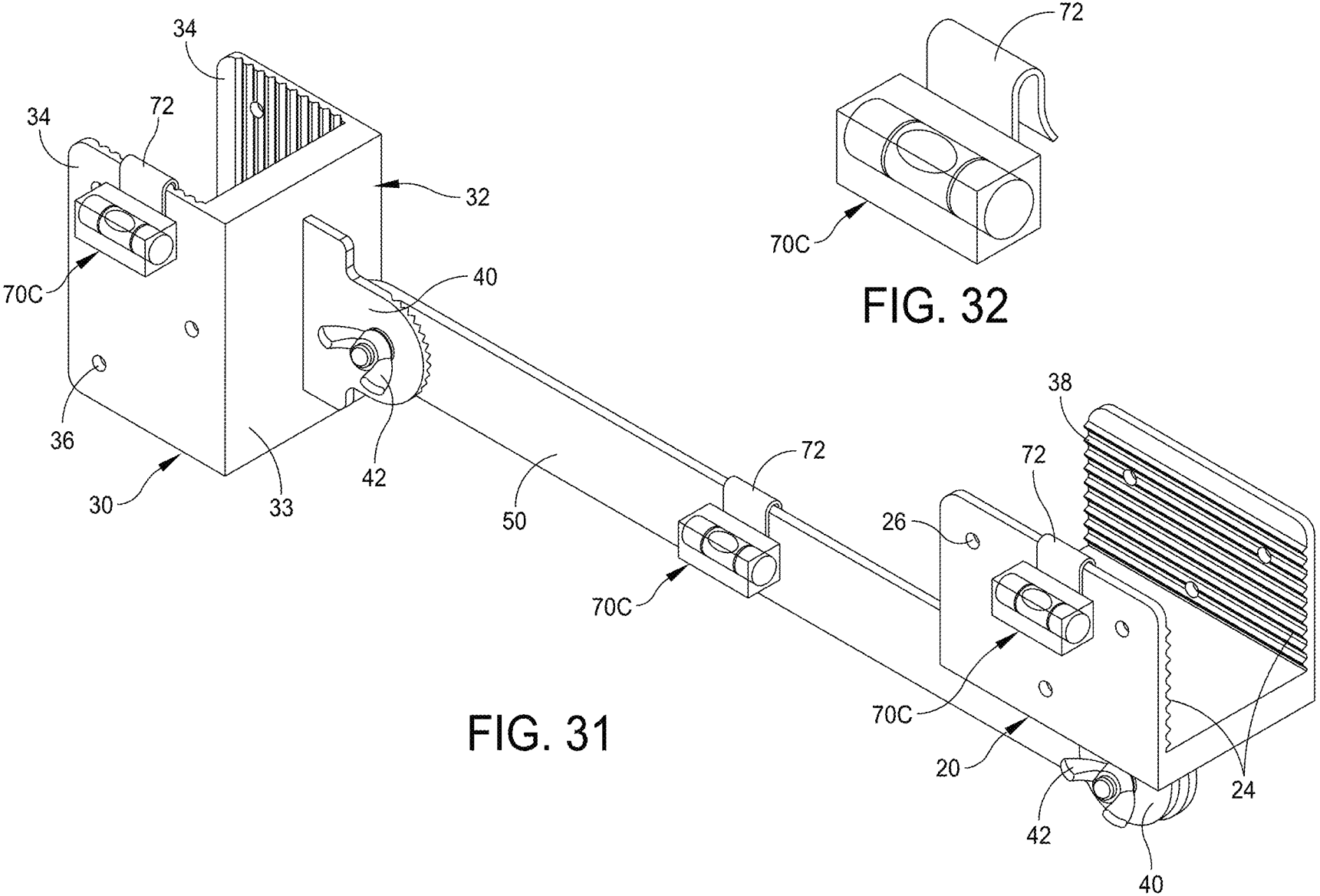
FIG. 31 is a perspective view of the post and beam support as embodied with a further embodiment of a leveling member which is attached to the respective brackets and arm by a clip.
FIG. 32 is a front perspective view of the leveling member of FIG. 31.
Figure 33:
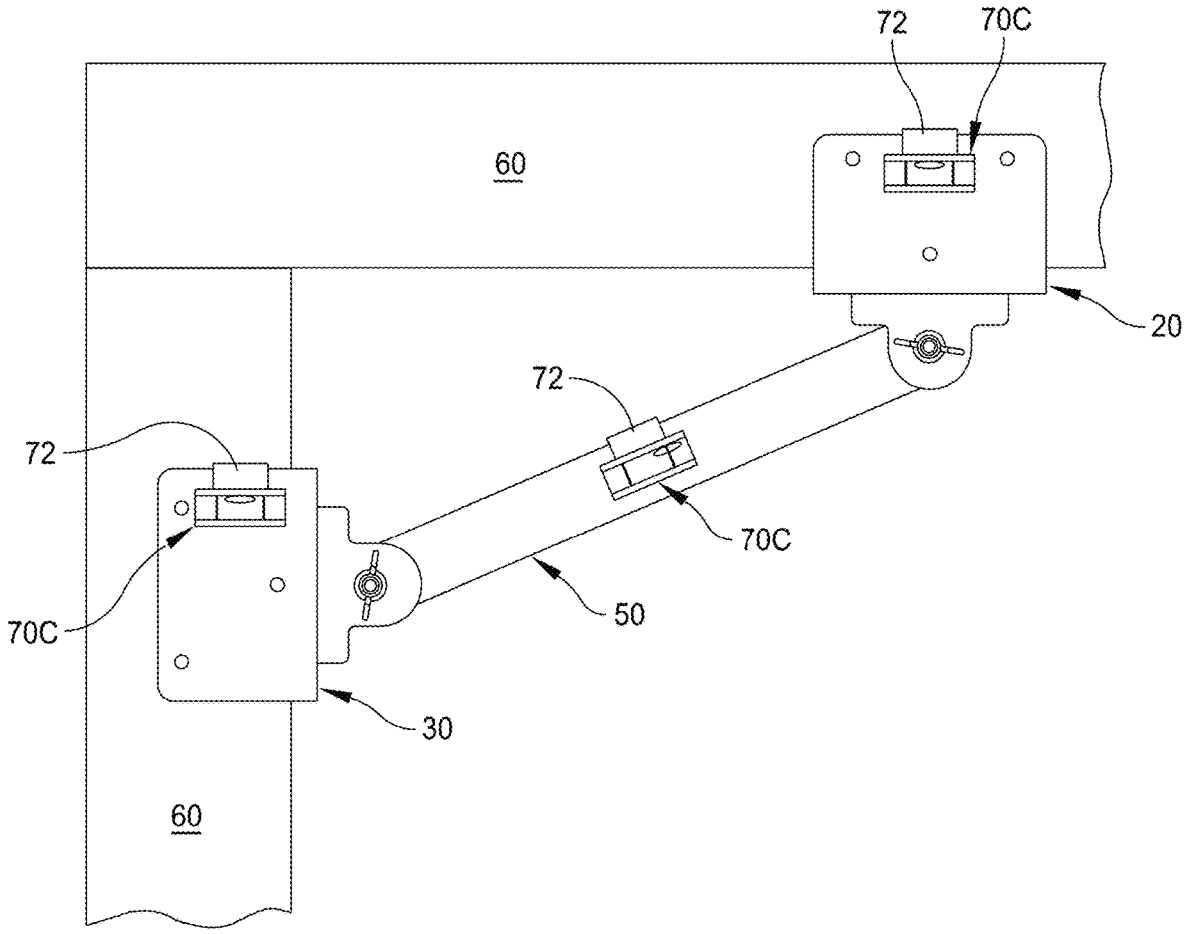
FIG. 33 is a front view of the post and beam support as would appear in an "in use" condition illustrating leveling members as described in FIGS. 31 and 32.

FIG. 31 is a perspective view of the post and beam support as embodied with a further embodiment of a leveling member which is attached to the respective brackets and arm by a clip. FIG. 32 is a front perspective view of the leveling member of FIG. 31. FIG. 33 is a front view of the post and beam support as would appear in an "in use" condition illustrating leveling members as described in FIGS. 31 and 32. In the embodiment illustrated in FIGS. 31-33, the leveling member 70C is preferably held by means of a clip 72. As is illustrated in, for example, FIG. 31, the clip 72 may be secured about an edge of a bracket wall or an edge of the arm 50. The clip 72 firmly holds the leveling member in place. Refer also to the side view of FIG. 33 which shows the manner in which the leveling members can be observed. These leveling members are helpful in properly orienting the various components that are being secured.

Figure 37:
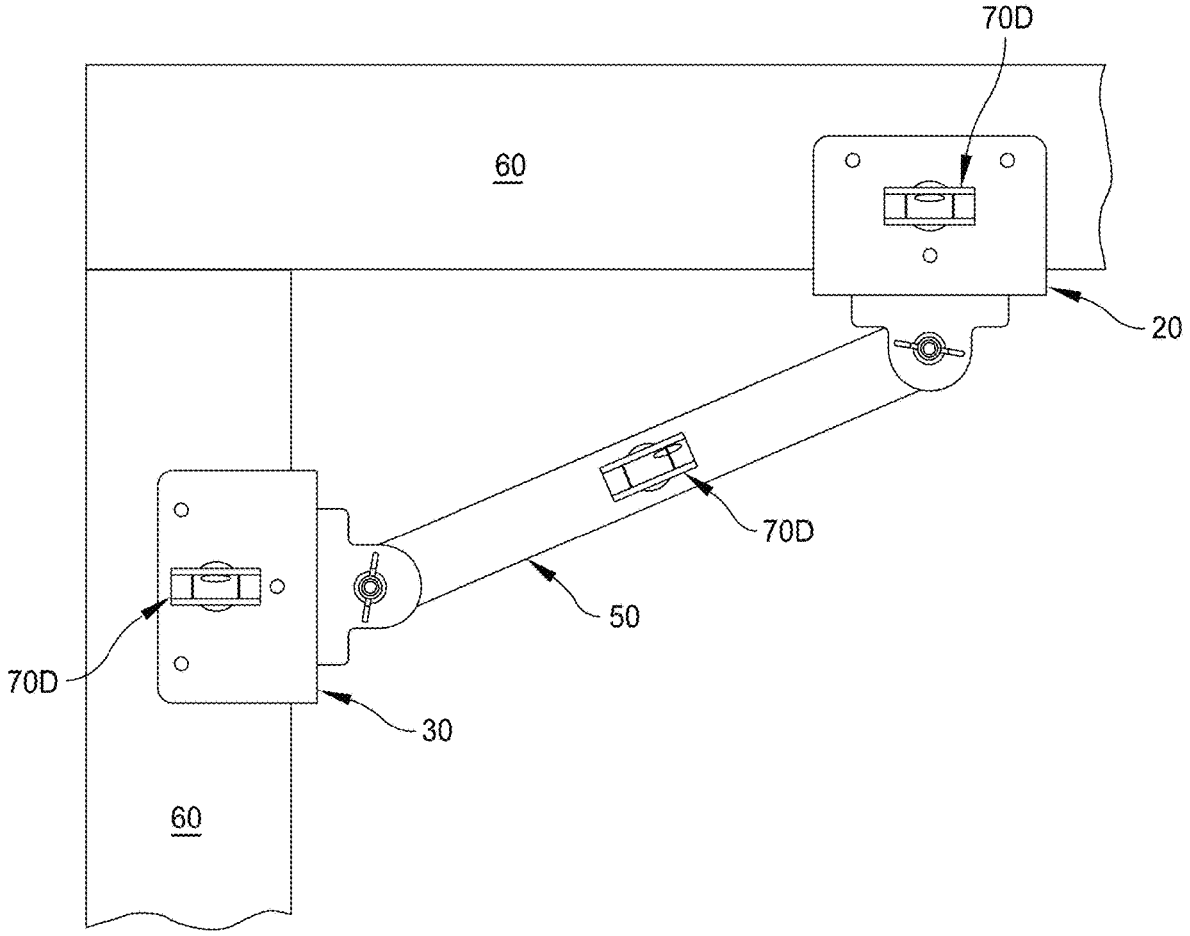
FIG. 37 is a front view of the post and beam support of the embodiment illustrated in FIGS. 34-36.

FIG. 34 is a front perspective view of the post and beam support of the present invention in which there is provided a leveling member that may be comprised of an air bubble level attached by a magnetic means. FIG. 35 is a front perspective view showing the leveling member of FIG. 34. FIG. 36 is a rear perspective view of the leveling member of FIG. 34. FIG. 37 is a front view of the post and beam support of the embodiment illustrated in FIGS. 34-36. In the embodiments illustrated in FIGS. 34-37, the leveling member 70D is secured to the respective brackets and arm by means of the use of a magnet 74. The magnet 74 is secured to a sidewall of each of the brackets 20/30 and is also secured to a sidewall of the arm 50. The leveling member 70D has an attractive strip 76. In that way the leveling members 70D can be easily secured in position and removed when not in use.

| REFERENCE NUMBERS | |
|---|---|
| beam support structure | 10 |
| first bracket | 20 |
| flat bracket | 20A |
| first bracket base wall | 22 |
| first bracket base wall flat surface | 23 |
| first bracket side walls | 24 |
| first bracket side wall holes | 26 |
| second bracket | 30 |
| second bracket base wall | 32 |
| second bracket base wall flat surface | 33 |
| second bracket side walls | 34 |
| second bracket side wall holes | 36 |
| bracket roughened or grooved surface | 38 |
| bracket flange | 40 |
| bracket fasteners | 42 |
| nails | 44 |
| arm | 50 |
| arm end | 52 |
| arm flat surface | 53 |
| opposite arm end | 54 |
| gasket | 56 |
| beam/post | 60 |
| holes | 62/64 |
| leveling member | 70A |
| leveling member | 70B |
| leveling member | 70C |
| leveling member clip | 72 |
| leveling member | 70D |

-continued

| REFERENCE NUMBERS | |
|---|---|
| magnet | 74 |
| magnetic strip | 76 |
| arrow (rotation of one bracket relative to the other) | A |

Having now described a limited number of embodiments of the present invention, it should now be apparent to those skilled in the art that numerous other embodiments and modifications thereof are contemplated as falling within the scope of the present invention, as defined by the appended claims.

The invention claimed is:

1. A beam support structure that is comprised of:

a first bracket for supporting a first beam;

a second bracket for supporting a second beam;

each of said first and second brackets having a flat surface to receive an edge of a corresponding beam; and an arm having respective ends that connect between the first and second brackets;

said arm being secured between the first and second brackets, while allowing multiple different secured positions between the first and second brackets;

wherein at least one bracket is U-shaped including a base wall that defines the flat surface, and further including a first leveling member secured to a sidewall of the first bracket, a second leveling member secured to a sidewall of the second bracket and a third leveling member secured to a sidewall of the arm.

2. The beam support structure of claim 1 wherein each U-shaped bracket also includes opposed side walls.

3. The beam support structure of claim 2 further including a flange supported from the base wall of each bracket.

4. The beam support structure of claim 2 further including a first fastener for securing one end of the arm to the flange of the first bracket and a second fastener for securing an opposite end of the arm to the flange of the second bracket.

5. The beam support structure of claim 3 wherein each fastener is comprised of either a wing nut or nut.

6. The beam support structure of claim 3 wherein the one end of the arm has a flat surface that rests against the base wall.

7. The beam support structure of claim 6 wherein the one end of the arm also rests against the flange.

8. The beam support structure of claim 3 wherein the sidewalls have respective facing surfaces that are grooved to enhance gripping with the beam.

9. The beam support structure of claim 6 wherein the opposite end of the arm is configured to enable rotation between the one end of the arm and the second bracket to provide relative positioning between respective beams that are being supported.

10. The beam support structure of claim 4 wherein each bracket includes one or more holes in the side walls for accommodating nails or screws for securing each bracket to a respective beam.

11. The beam support structure of claim 10 wherein the flange is disposed at either a center area of the base wall or at a side edge of the base wall.

12. The beam support structure of claim 1 wherein the first bracket is a U-shaped bracket and the second bracket is a flat plate.

13. The beam support structure of claim 1, wherein the leveling member is in the form of a small container that rigidly holds an air bubble level in a proper position, wherein the small container of the leveling member is secured to the bracket or the arm; and wherein the small container is embedded within the walls of the brackets or within the sidewall of the arm.

14. A beam support structure that is comprised of a first bracket for supporting a first beam or post; a second bracket for supporting a second beam; each of said first and second brackets being of U-shape including a base wall and a pair of side walls that extend orthogonal to the base wall, and a support flange that extends parallel to the pair of side walls and an arm having respective ends that connect between the respective flanges of the first and second brackets; said arm being secured between the first and second brackets, while allowing multiple different secured positions between the first and second brackets; wherein the first bracket is a U-shaped bracket and the second bracket is a flat plate further including a first fastener for securing one end of the arm to the flange of the first bracket and a second fastener for securing an opposite end of the arm to the flange of the second bracket, and further including a first leveling member secured to a sidewall of the first bracket, a second leveling member secured to a sidewall of the second bracket and a third leveling member secured to a sidewall of the arm.

15. The beam support structure of claim 14 wherein each fastener is comprised of either a wing nut or nut, the first bracket is a U-shaped bracket and the second bracket is a flat plate.

16. The beam support structure of claim 14 wherein the one end of the arm has a flat surface that rests against the base wall.

17. The beam support structure of claim 16 wherein the one end of the arm also rests against the flange.

18. A beam support structure that is comprised of a first bracket for supporting a first beam or post; a second bracket for supporting a second beam; each of said first and second brackets being of U-shape including a base wall and a pair of side walls that extend orthogonal to the base wall, and a support flange that is attached to an outwardly facing surface of the base wall, that extends parallel to the pair of side walls and that has opposite planar surfaces; the pair of side walls extending in an opposite direction to the flange for both the first and second brackets; and an arm having respective one proximal and other distal ends that connect between the respective flanges of the first and second brackets; said arm being secured between the first and second brackets by respective fasteners; wherein the one proximal end of the arm has a narrow free-end flat surface that rests against the outwardly facing surface of the base wall, wherein the one proximal end of the arm also rests against the flange by virtue of one of the side surfaces of the arm resting against one of the opposite planar surfaces of the support flange; further including a first fastener for securing the one end of the arm to the flange of the first bracket and a second fastener for securing the other distal end of the arm to the flange of the second bracket; wherein both the support flange and arm have aligned holes for receiving the respective first and second fasteners.

19. The beam support structure of claim 18 wherein each fastener is comprised of a wing nut.

20. The beam support structure of claim 18 wherein the other distal end of the arm is arcuate so as to allow a pivoting action between the arm and second bracket through at least 90 degrees.

* * * * *